US010993873B1

(12) United States Patent
Haddock DiCarlo et al.

(10) Patent No.: US 10,993,873 B1
(45) Date of Patent: May 4, 2021

(54) PRESSURE FIELD STIMULATION DEVICE

(71) Applicant: Uccellini LLC, Bend, OR (US)

(72) Inventors: Lora LeeAnne Haddock DiCarlo, Bend, OR (US); Douglas S. Layman, Bend, OR (US); Ada-Rhodes Short, Corvallis, OR (US); Kim Porter Henneman, Bend, OR (US); Mark Hazelton, Philomath, OR (US); Brian Scott Gaza, Naperville, IL (US); Lola Vars, Corvallis, OR (US)

(73) Assignee: Uccellini LLC, Bend, OR (US)

( * ) Notice: Subject to any disclaimer, the term of this patent is extended or adjusted under 35 U.S.C. 154(b) by 0 days.

(21) Appl. No.: 16/985,558

(22) Filed: Aug. 5, 2020

Related U.S. Application Data

(60) Provisional application No. 62/991,545, filed on Mar. 18, 2020, provisional application No. 62/963,783, filed on Jan. 21, 2020, provisional application No. 62/957,267, filed on Jan. 5, 2020.

(51) Int. Cl.
*A61H 19/00* (2006.01)
*A61H 23/02* (2006.01)

(52) U.S. Cl.
CPC ..... *A61H 19/44* (2013.01); *A61H 19/34* (2013.01); *A61H 23/0254* (2013.01)

(58) Field of Classification Search
USPC ..... 248/188
See application file for complete search history.

(56) References Cited

U.S. PATENT DOCUMENTS

| | | | | |
|---|---|---|---|---|
| 6,099,463 | A | 8/2000 | Hockhalter | |
| 6,733,438 | B1 | 5/2004 | Dann et al. | |
| 7,530,944 | B1 | 5/2009 | Kain | |
| 8,308,631 | B2 | 11/2012 | Kobashikawa et al. | |
| 8,439,855 | B2 * | 5/2013 | Knyrim ..... | A61H 23/0254 601/46 |

(Continued)

FOREIGN PATENT DOCUMENTS

| | | |
|---|---|---|
| AU | 2018200317 A1 | 2/2018 |
| CN | 105596194 | 5/2016 |

(Continued)

OTHER PUBLICATIONS

Rodriguez, Ariana, "Womanizer Releases New Products, hits Sales Milestone", XBIX.com, Jan. 19, 2018, 13 pgs.

(Continued)

*Primary Examiner* — Monica E Millner
(74) *Attorney, Agent, or Firm* — Maxine Lynn Barasch; Keohane & D'Alessandro, PLLC

(57) ABSTRACT

Embodiments of the present invention relate to an improved stimulation device. Embodiments of the improved stimulation device includes a cup and a driver. The cup has a cavity surrounded by a rim. The driver comprises a plate disposed on an underside of the cup, a cam disposed adjacent to the plate, and a motor mechanically coupled to the cam. The driver comprises a cam pin affixed to the cam, and a bearing rotatably disposed on the cam pin. The bearing is mechanically coupled to a lifter. The lifter is mechanically coupled to a linear bearing, enabling a smooth reciprocating back-and-forth motion from the rotation of the motor. A top of the cup swells and unswells during an operation cycle of the driver.

21 Claims, 35 Drawing Sheets

(56) References Cited

U.S. PATENT DOCUMENTS

| | | | | |
|---|---|---|---|---|
| 8,545,392 | B2 * | 10/2013 | Standfest | A61H 19/50 600/38 |
| 8,579,837 | B1 | 11/2013 | Makower et al. | |
| D712,059 | S | 8/2014 | Sedic | |
| 9,339,434 | B1 | 5/2016 | Mayfield | |
| 9,737,457 | B2 * | 8/2017 | Allen | A61H 19/34 |
| 9,737,458 | B1 | 8/2017 | Olivares et al. | |
| 9,763,851 | B2 * | 9/2017 | Lenke | G06F 16/9535 |
| 9,849,061 | B2 * | 12/2017 | Lenke | A61H 23/02 |
| 9,937,097 | B2 | 4/2018 | Lenke | |
| 10,004,659 | B1 | 6/2018 | Campbell | |
| D825,073 | S | 8/2018 | Lenke | |
| D848,013 | S | 5/2019 | Fuhner et al. | |
| 2003/0176817 | A1 | 9/2003 | Chang | |
| 2004/0082831 | A1 | 4/2004 | Kobashikawa et al. | |
| 2004/0186344 | A1 | 9/2004 | Jannuzzi | |
| 2005/0240122 | A1 | 10/2005 | Gander et al. | |
| 2005/0256369 | A1 | 11/2005 | Gloth | |
| 2005/0273024 | A1 | 12/2005 | Nan | |
| 2007/0142754 | A1 | 6/2007 | Nan | |
| 2008/0071138 | A1 | 3/2008 | Mertens et al. | |
| 2008/0312674 | A1 * | 12/2008 | Chen | A61M 1/0058 606/162 |
| 2009/0069730 | A1 | 3/2009 | Knyrim | |
| 2010/0268021 | A1 | 10/2010 | Standfest et al. | |
| 2011/0124959 | A1 | 5/2011 | Murison | |
| 2013/0012769 | A1 | 1/2013 | Carlson | |
| 2013/0178769 | A1 | 7/2013 | Schmidt | |
| 2013/0261385 | A1 * | 10/2013 | Zipper | A61H 19/34 600/38 |
| 2014/0228628 | A1 | 8/2014 | De Alva | |
| 2014/0309565 | A1 | 10/2014 | Allen | |
| 2015/0196455 | A1 | 7/2015 | Mertens et al. | |
| 2016/0022532 | A1 | 1/2016 | Makower et al. | |
| 2016/0045392 | A1 | 2/2016 | Massey et al. | |
| 2016/0213557 | A1 | 7/2016 | Lenke | |
| 2017/0027809 | A1 | 2/2017 | Lenke | |
| 2017/0065483 | A1 | 3/2017 | Lenke | |
| 2017/0100303 | A1 | 4/2017 | Kotlov | |
| 2017/0216135 | A1 | 8/2017 | Lenke | |
| 2017/0281457 | A1 | 10/2017 | Witt | |
| 2017/0326022 | A1 * | 11/2017 | Fima | A61H 19/44 |
| 2018/0092799 | A1 | 4/2018 | Lenke | |
| 2018/0140502 | A1 | 5/2018 | Shahoian et al. | |
| 2018/0153764 | A1 | 6/2018 | Lenke | |
| 2018/0243161 | A1 | 8/2018 | Lenke | |
| 2018/0243162 | A1 | 8/2018 | Lenke | |
| 2020/0085676 | A1 * | 3/2020 | Haddock | A61H 19/40 |
| 2020/0085677 | A1 * | 3/2020 | Haddock | A61H 19/34 |
| 2020/0085678 | A1 * | 3/2020 | Haddock | A61H 1/00 |
| 2020/0085679 | A1 * | 3/2020 | Haddock | A61H 19/34 |

FOREIGN PATENT DOCUMENTS

| | | | |
|---|---|---|---|
| CN | 206198255 | | 5/2017 |
| EP | 3300712 | A1 | 4/2018 |
| JP | 10165465 | | 6/1998 |
| WO | 2011094799 | A1 | 8/2011 |
| WO | 2013067367 | A1 | 5/2013 |
| WO | 2014085736 | A1 | 6/2014 |
| WO | 2017158107 | A1 | 9/2017 |
| WO | 2017205860 | A1 | 11/2017 |

OTHER PUBLICATIONS

"Irresistible", by Shots, www.ean-online.com/ebooks/EAN_06_2019, 2019, 1 pgs.

"SHOTS—Irresistible—MYTHICAL—Touchless Clotorial Stimulation", www.youtube.com/watch?v=9hjxKpQBCVU, May 31, 2019, 4 pgs.

"SHOTS—Irresistible Collection—Promo" https://www.youtube.com/watch?v=ixi_jvwV8g8, Mar. 26, 2019, 1 pg.

Thomas, Shane, International Application No. PCT/US2019/50932, Search Report & Written Opinion, dated Nov. 27, 2019, 19 pgs.

EP Application No. 19817568.9, Partial Search Report, dated Jul. 17, 2020, 37 pgs.

Takahashi, Dean, "Lora DiCarlo starts presales for once-banned Ose Sex Toy", Venture Beat,https://venturebeat.com/2019/11/26/lora-dicarlo-starts-presales-for-once-banned-ose-sex-toy/, Nov. 26, 2019, 6 pgs.

Video showing motion of cup, posted to www.LoraDiCarlo.com Nov. 2020. Included are screenshots from the video, 2 pgs.

Applicant's Ose' device (interior). Products shipped to customers first on Jan. 23, 2020.

* cited by examiner

PRESSURE FIELD STIMULATION DEVICE

CROSS-REFERENCE TO RELATED APPLICATIONS

The present patent document claims priority to U.S. provisional patent application Ser. No. 62/957,267, filed Jan. 5, 2020, U.S. provisional patent application Ser. No. 62/963,783, filed Jan. 21, 2020, and U.S. provisional patent application Ser. No. 62/991,545, filed Mar. 18, 2020, all titled "PRESSURE FIELD STIMULATION DEVICE". The entire disclosures of such applications are incorporated herein by reference.

FIELD

Embodiments of the invention relate to a stimulation device, and more particularly, to an air pressure field stimulation device.

BACKGROUND

Stimulation of skin has many beneficial effects, including raising blood flow in the area, and stimulating nerve endings. In addition, on a human body, a vulva includes organs including a clitoris, mons pubis, labia majora, and labia minora surrounding the vagina. The glans clitoris is a portion of the clitoris that is on the vulva, external to the vagina. The glans clitoris is sexually responsive, having thousands of nerve endings. The vulva (and vagina) is sexually responsive as well. Stimulation of a person's glans clitoris increases blood flow to the area and provides sexual pleasure. There exists a need for improvements in devices that can provide increased stimulation.

SUMMARY

In embodiments, there is provided a stimulation device, comprising: a cup formed of a flexible resilient material comprising a cavity; and a driver, the driver comprising: a plate disposed on an underside of the cup; a cam disposed adjacent to the plate; a cam pin extending from the cam; a bearing disposed on the cam pin; a motor mechanically coupled to the cam; and a lifter mechanically coupled to the bearing, said lifter also mechanically coupled to the plate.

In embodiments, there is provided a stimulation device, comprising: a cup formed of a flexible resilient material comprising a cavity; a driver, the driver comprising: a plate disposed on an underside of the cup; a cam disposed adjacent to the plate; a cam pin extending from the cam; a bearing disposed on the cam pin; a motor mechanically coupled to the cam; and a lifter mechanically coupled to the bearing, said lifter also mechanically coupled to the plate; a processor; and a memory containing instructions that when executed by the processor cause the driver to vary a volume of the cavity of the cup from a first volume to a second volume.

In embodiments, there is provided a stimulation device, comprising: a cup having a cavity, the cup formed of a flexible resilient material, the cavity having an opening; and a driver configured to vary a volume of the cavity through an operation cycle; wherein a top surface of the cup is joined to side walls of the cup at a inflection point; wherein the top of the cup is configured and disposed to undergo expansion and contraction during the operation cycle.

In embodiments, there is provided a stimulation device, comprising: a cup formed of a flexible resilient material, and having a cavity, wherein the top of the cup is joined with outer side walls of the cup at inflection points; a driver; a processor; and a memory containing instructions that when executed by the processor cause the driver to vary a volume of the cavity of the cup from a first volume to a second volume; wherein the top of the cup is configured to swell on a surface extending between the inflection points during variation from the first volume to the second volume; and wherein the top of the cup is configured to unswell on the surface during variation from the second volume to the first volume.

In embodiments, there is provided a stimulation device, comprising: a cup formed of a flexible resilient material, and having a cavity, wherein a top of the cup is joined to side walls of the cup at inflection points; a driver; a processor; and a memory containing instructions that when executed by the processor cause the driver to contract and expand a volume of the cavity of the cup; wherein the top of the cup is configured to swell on a surface extending between the inflection points during contraction; and wherein the top of the cup is configured to unswell on the surface during expansion.

17B is a diagram showing details of the motor controller.

Figure 18B:
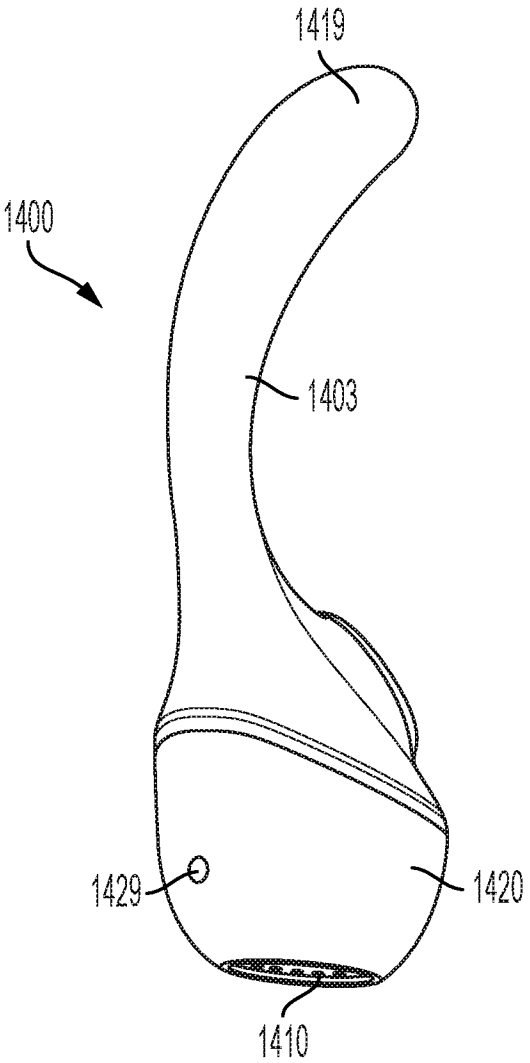
Figure 18A:
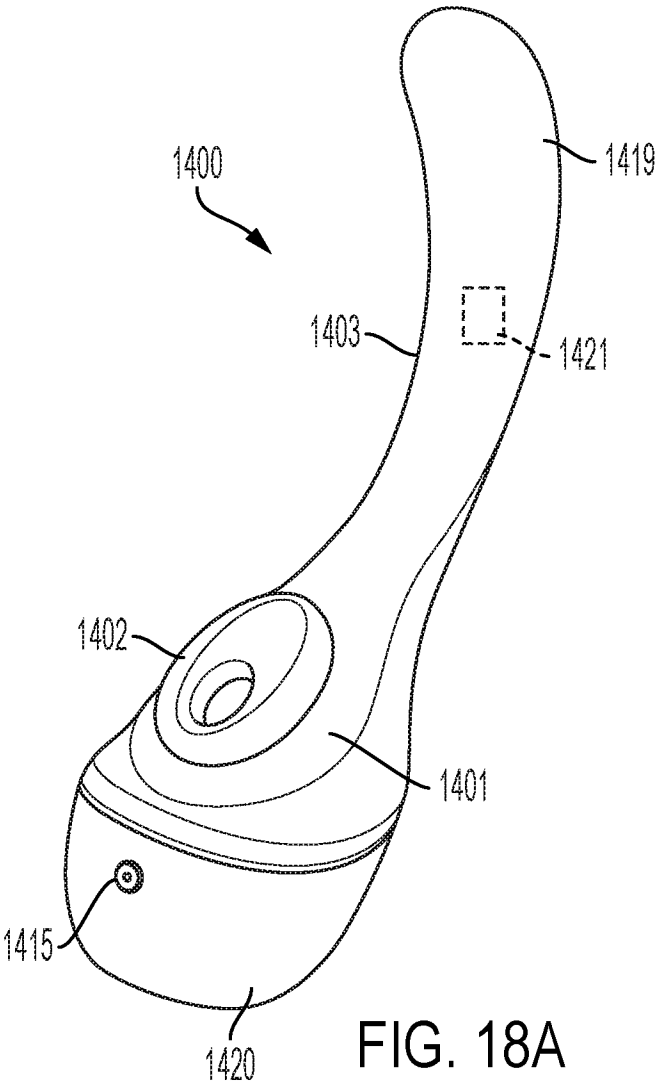

FIG. 18A shows a front side perspective view of a stimulation device in accordance with some embodiments of the present invention.

FIG. 18B shows a rear side perspective view of the stimulation device of FIG. 18A.

Figure 19:
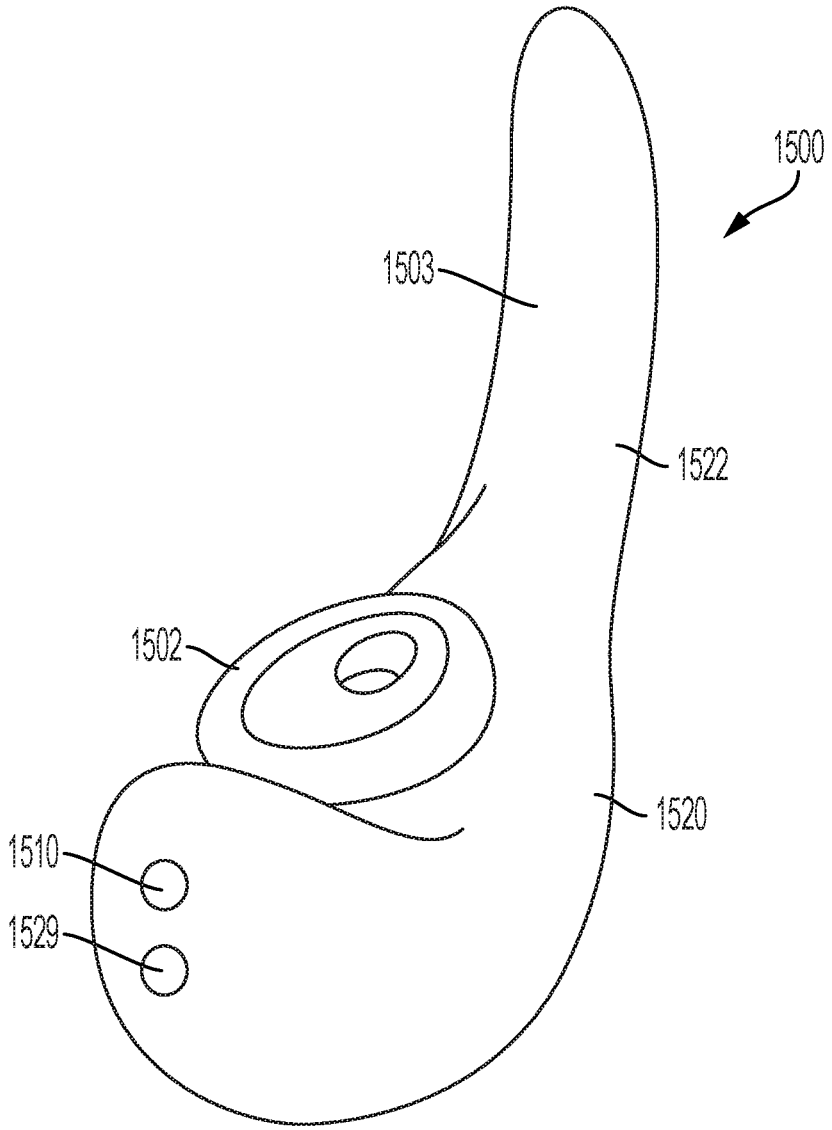

FIG. 19 shows another embodiment of a pressure field stimulation device in accordance with some embodiments of the present invention.

Figure 20B:
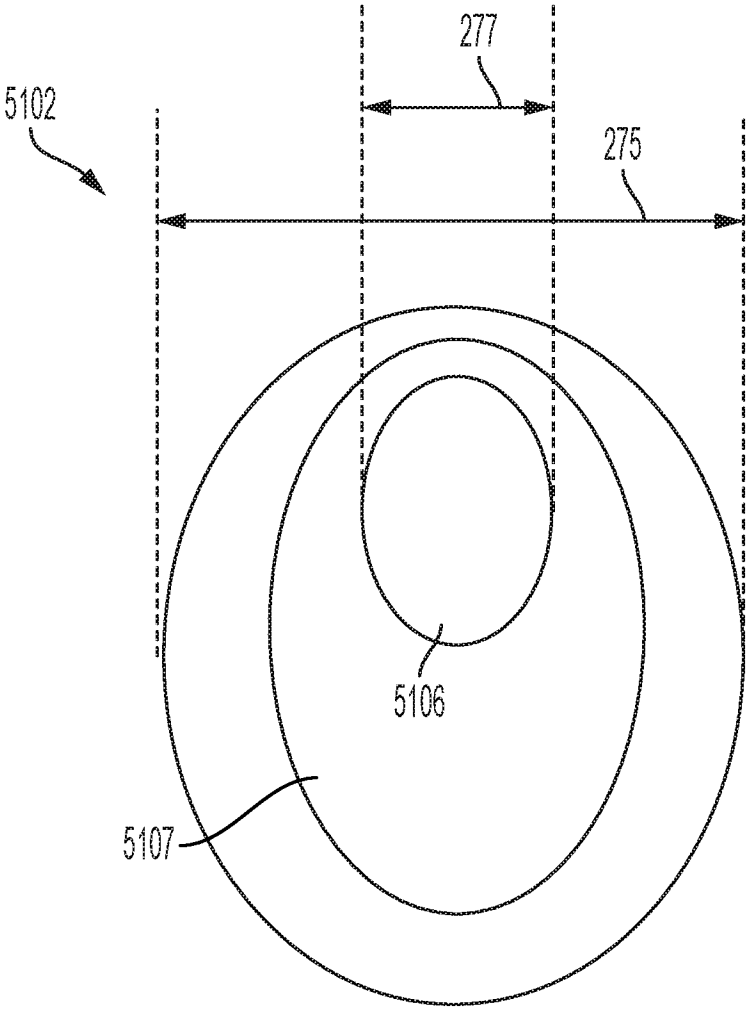
Figure 20A:
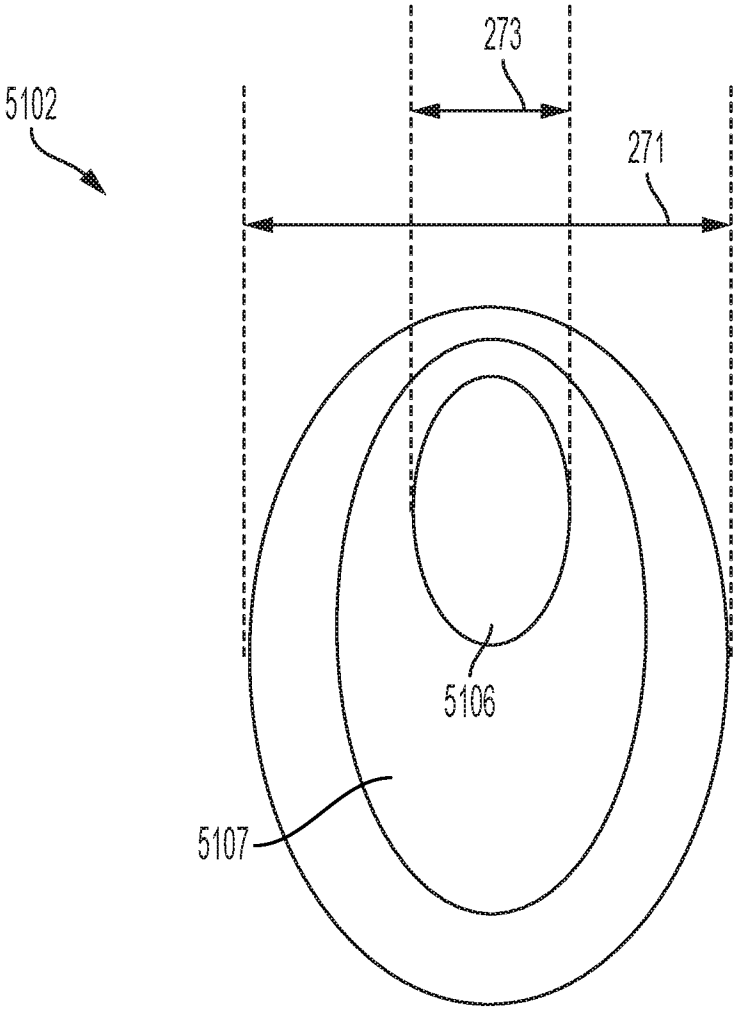

FIG. 20A is a top-down view of a cup illustrating lateral expansion during the operation cycle.

FIG. 20B is a top-down view of a cup illustrating lateral contraction during the operation cycle.

Figure 21A:
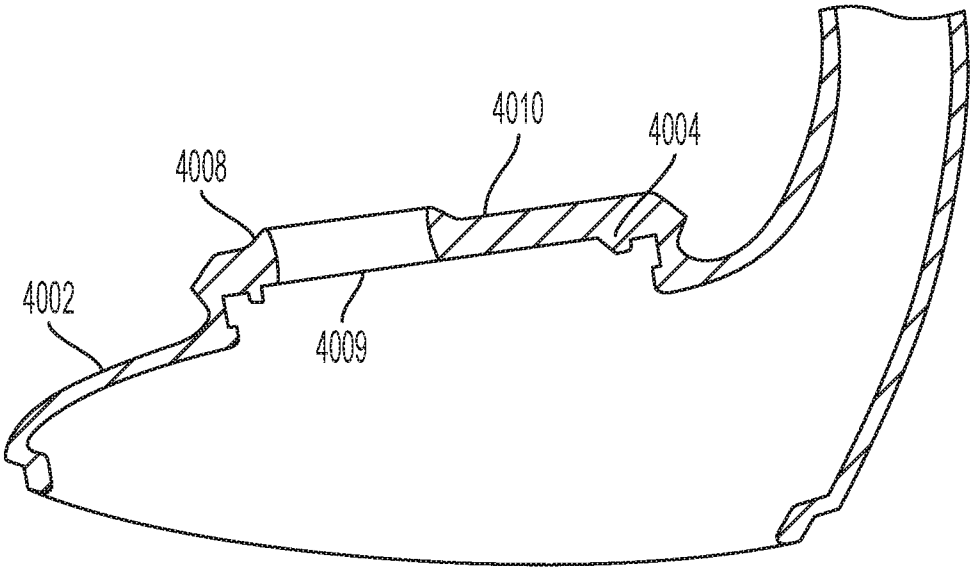

FIG. 21A shows the outer cup portion in an unswelled position.

Figure 21B:
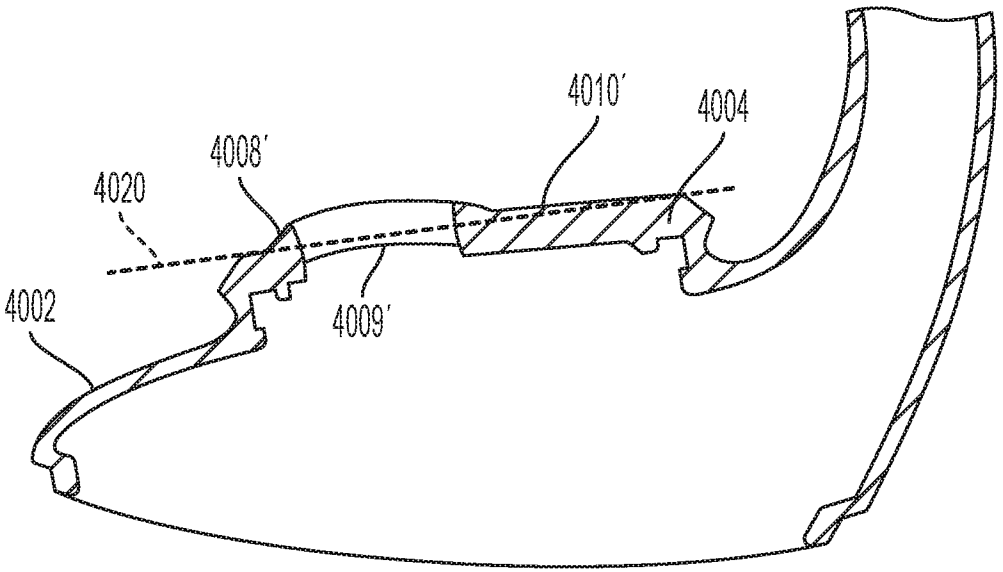

FIG. 21B shows the outer cup portion in a swelled position.

Figure 22A:
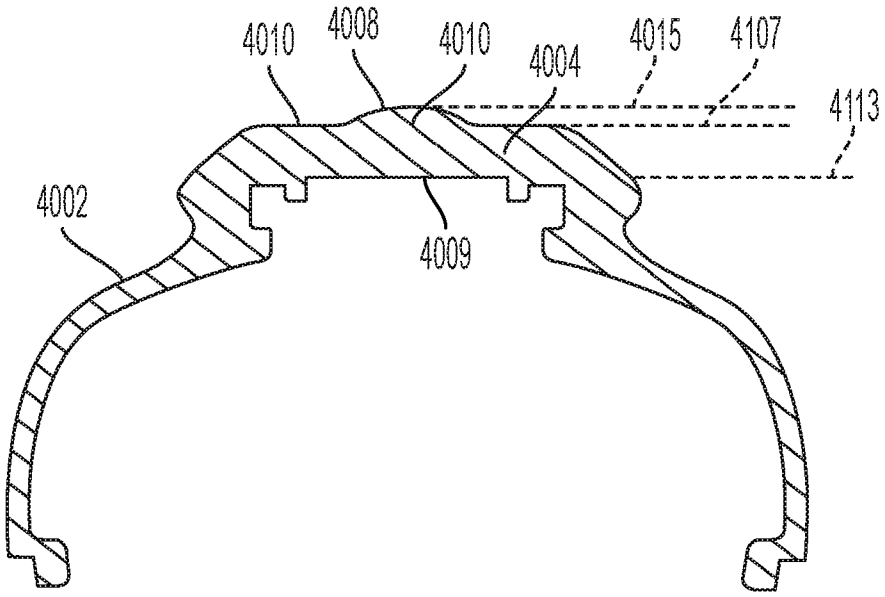

FIG. 22A shows a front cross-section view of an outer cup portion/sleeve in an unswelled position.

Figure 22B:
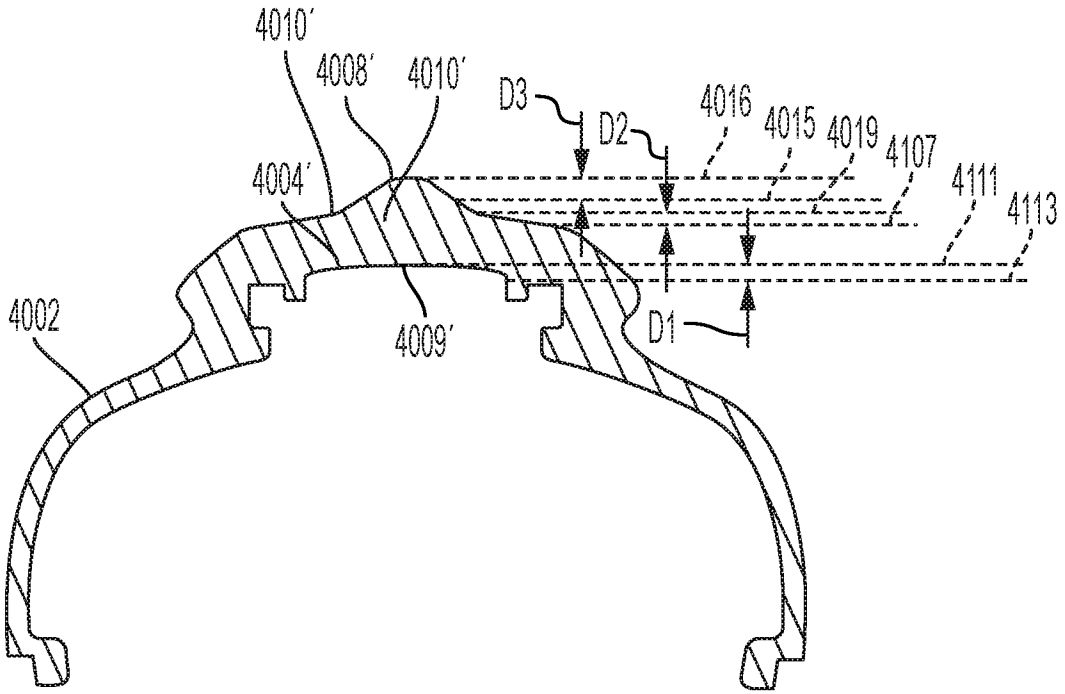

FIG. 22B shows a front cross-section view of an outer cup portion/sleeve in a swelled position.

Figure 23:
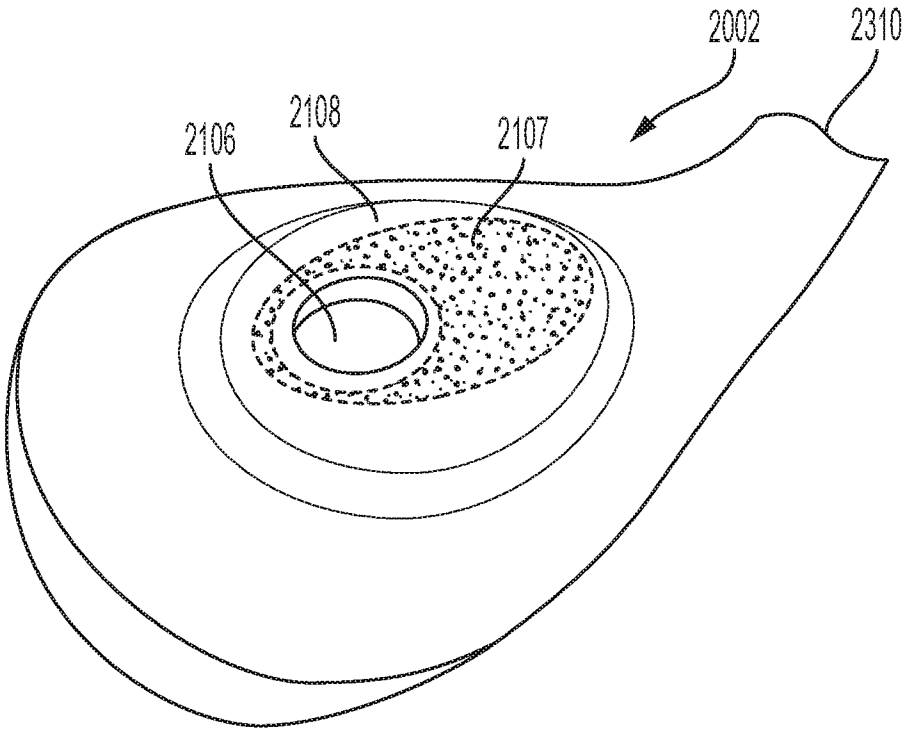

FIG. 23 shows a partial top-down view of an embodiment of the present invention.

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Disclosed embodiments provide an improved stimulation device. Embodiments of the improved stimulation device include a cup and a driver. The cup has a cavity surrounded by a rim. In use, a user positions the rim such that an opening to the cavity is over an area of a user's body to be stimulated (for example, the clitoris or other skin). A sealed, or substantially-sealed, chamber is formed by the cavity walls and the user's body (skin surrounding the clitoris or other body part). A driver is configured to vary a volume of the cavity of the cup from a first volume to a second volume, and from the second volume to the first volume. The driver is configured to repeat such operation cycle. In some embodiments, the second volume is smaller than the first volume, though this is not meant to be limiting. In some embodiments, the cup has a buckle region, which collapses and springs back out during volume changes. The springing out of the buckle region produces a "thud" or "thump" (used interchangeably herein), which is imparted to the user. In some embodiments, the stimulation device is a sex toy. In some embodiments, the stimulation device is a medical device.

Reference throughout this specification to "one embodiment," "an embodiment," "some embodiments", "embodiments," or similar language means that a particular feature, structure, or characteristic described in connection with the embodiment is included in at least one embodiment of the present invention. Thus, appearances of the phrases "in one embodiment," "in an embodiment," "in some embodiments", "in embodiments," and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements.

For the purposes of disclosure, the word, "substantially" is defined as "for the most part". It means "to a great extent," but having some room for some minor variation.

FIGS. 1A-1E show various views of an example cup 102 in accordance with some embodiments of the invention. In such figures, a legend "L" is used to indicate orientation of the various views of disclosed embodiments with respect to an X, Y, and Z axis.

Figure 1A:
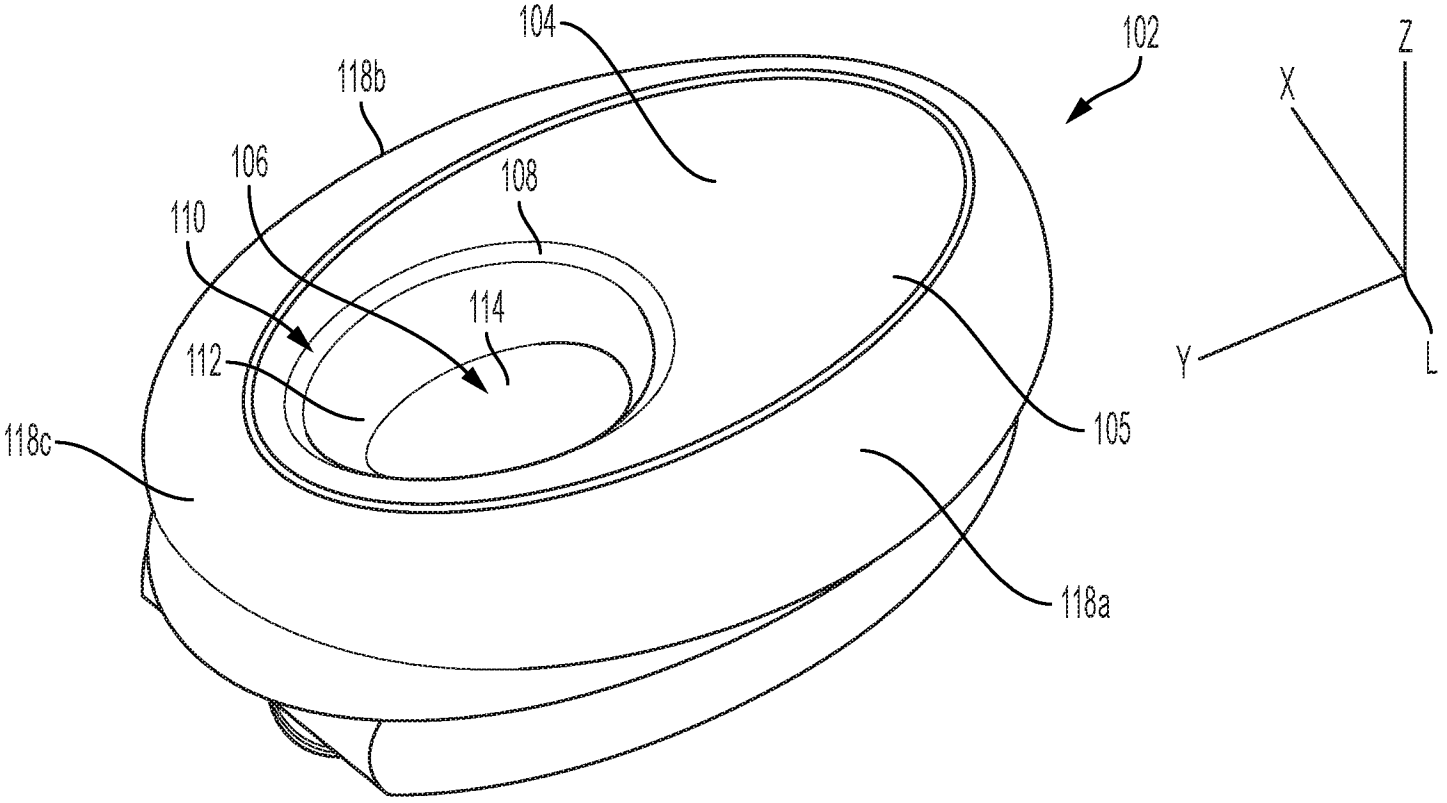
FIG. 1A is a perspective view of a cup in accordance with some embodiments of the present invention.

FIG. 1A is a perspective view of the example cup 102 in accordance with some embodiments of the present invention. Cup 102 includes a cavity 106. In some embodiments, cavity 106 is sized and configured to fit over a region of skin of a user's body. In some embodiments, the cavity is sized and configured to fit over the region of skin on a vulva surrounding a glans clitoris of a user (note that although described herein with respect to clitoral stimulation, it should be recognized that embodiments may be used for stimulation of any suitable body part, e.g., an ear). Cavity 106 has a rim 108 defining an opening 110 of the cavity. Cavity 106 is defined by an interior lateral wall 112 and a base 114 (bottom in the orientation shown). The lateral wall 112 and base 114 may together be a single continuous substantially-rounded concave wall, or may include edges between flat surfaces. The cavity 106 may be any suitable shape. In some embodiments, cavity 106 is oval in shape as shown here. In some embodiments, lateral wall 112 and base 114 are comprised of a single continuous material with the cup 102.

The cup's cavity 106 is adapted such that when rim 108 is placed on the skin of a user with the opening 110 over the area to be stimulated, a chamber filled with air is formed among the cavity walls 112, base 114, and the user's skin. The chamber is preferably sealed or substantially-sealed. Note that although herein, a "chamber" is referred to, in some embodiments, the chamber is comprised of several separate but connected compartments, such that air can flow between the compartments. Accordingly, the use of the word "chamber" in the singular is not meant to exclude split-chamber or multi-chamber configurations. "Pressure" as used herein refers to air pressure.

In some embodiments, the cup 102 additionally has a wing region formed thereon. There may be side wings 118*a*, 118*b* on each side of the cup 102, as well as a front wing 118*c*. In use for stimulation of a vulva, front wing 118*c* extends under the labia and under the mons pubis of a user to assist in holding the cup 102 to the skin of the user. This creates an improved seal of the chamber. Side wings 118*a* and 118*b* make contact with the labia during use for an improved seal and stimulation of the labia. Some embodiments may further include a basin 104 for improved seal.

Figure 1B:
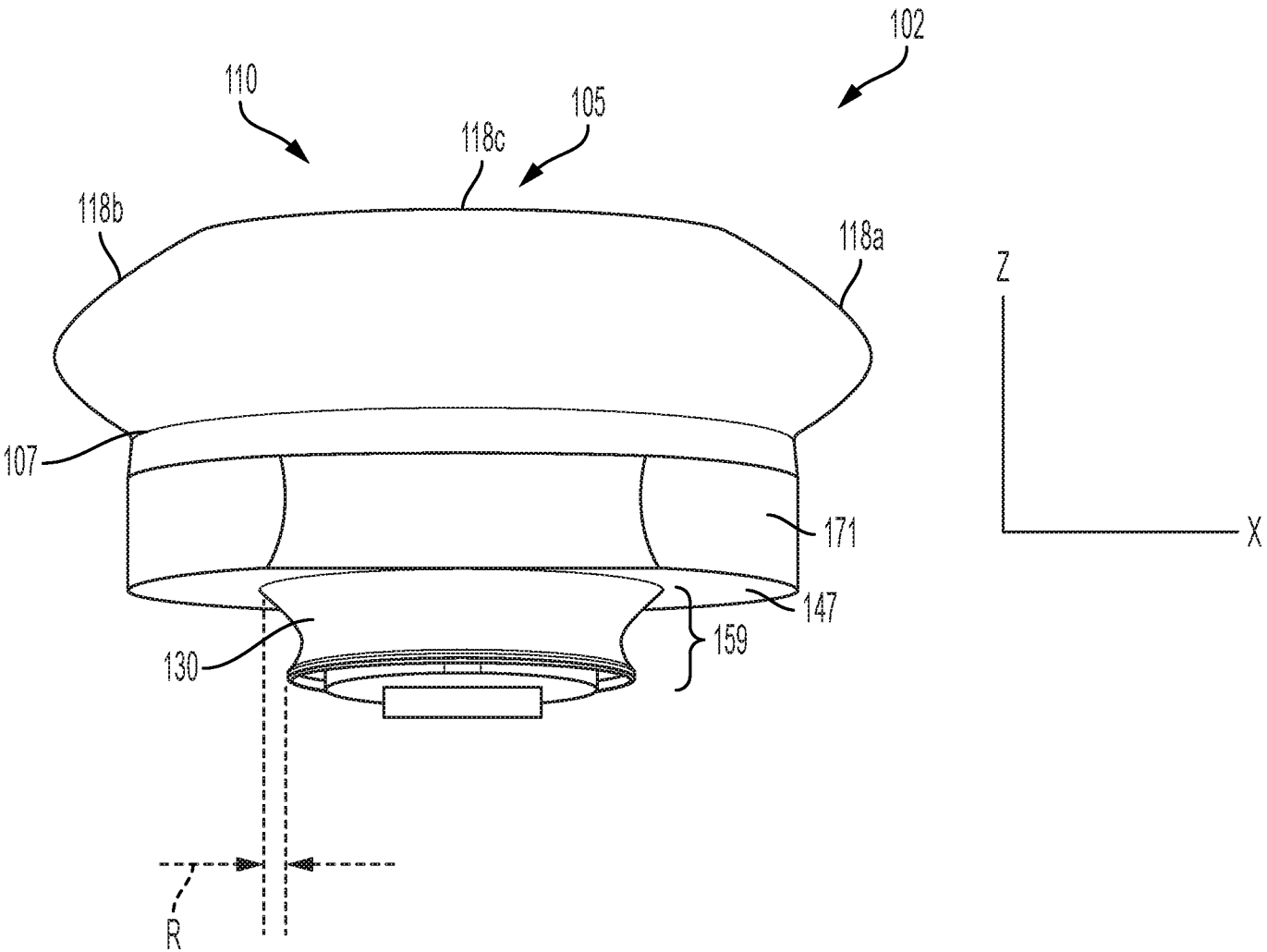
FIG. 1B shows a front view of the cup of FIG. 1A.

FIG. 1B shows a front view of the cup 102 of FIG. 1A. In this view, the wing regions 118*a*, 118*b*, and 118*c* are prominently shown. A buckle region wall 130 and an anchor wall 171 of cup 102 are in view. The buckle region wall 130 compresses and decompresses (i.e. expands/"springs out") during operation of the stimulation device, resulting in a variable volume of the cavity 106 (FIG. 1) of cup 102. The anchor wall 171 serves as an anchor for the buckling of the buckle region wall 130. The buckle region wall 130 forms a resilient protrusion 159 that extends from the underside (floor) 147 of the anchor wall 171 of the cup 102.

Figure 1C:
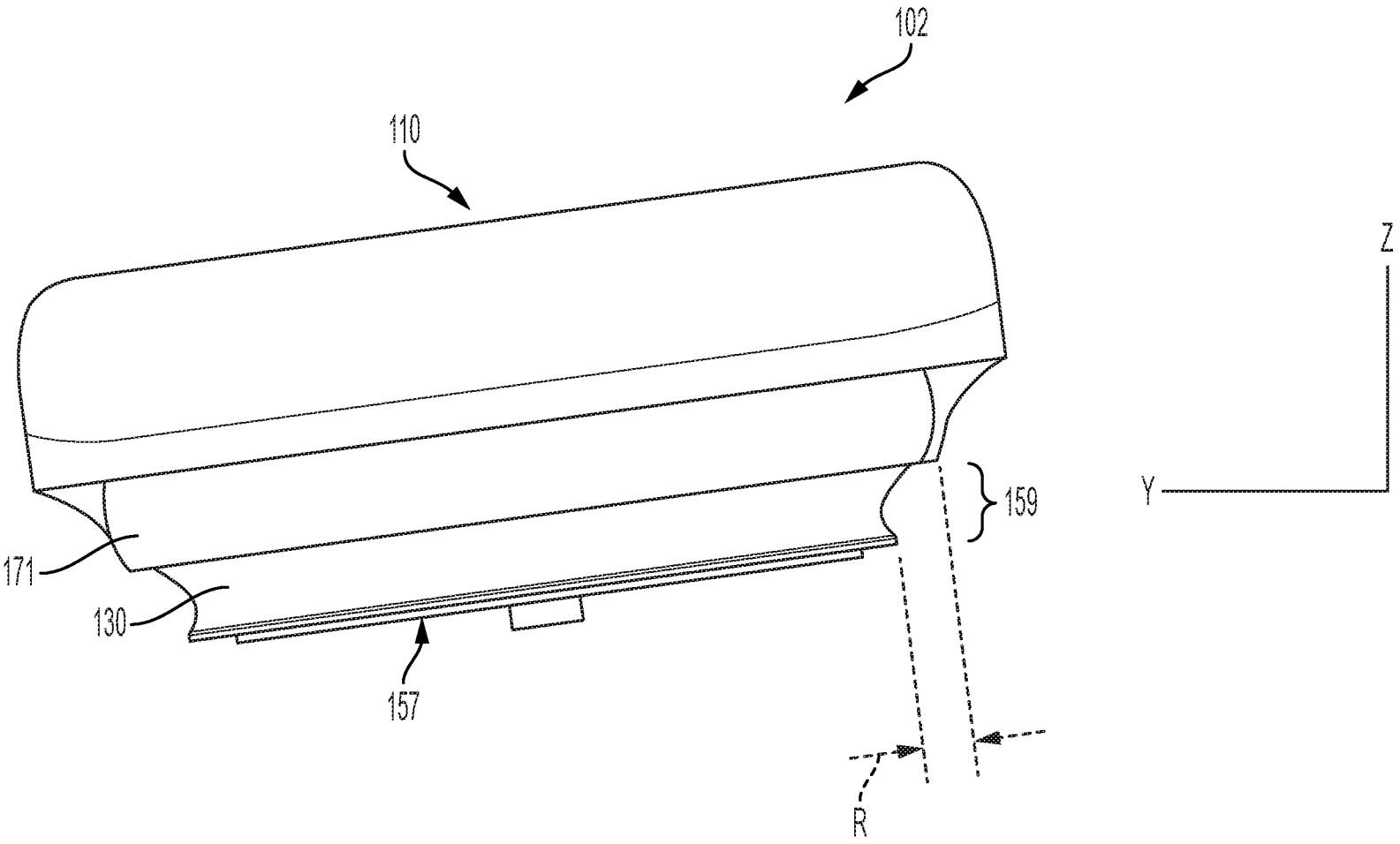
FIG. 1C is a side view of the cup of FIG. 1A.

FIG. 1C is a side view of the cup 102 of FIG. 1A. The opposite side of the cup 102 looks symmetrical in embodiments. Referring also to FIG. 1B, the buckle region wall 130 forms a resilient protrusion 159, which is the buckle region, that extends from the underside 157 of the anchor wall 171 of cup 102.

Figure 1D:
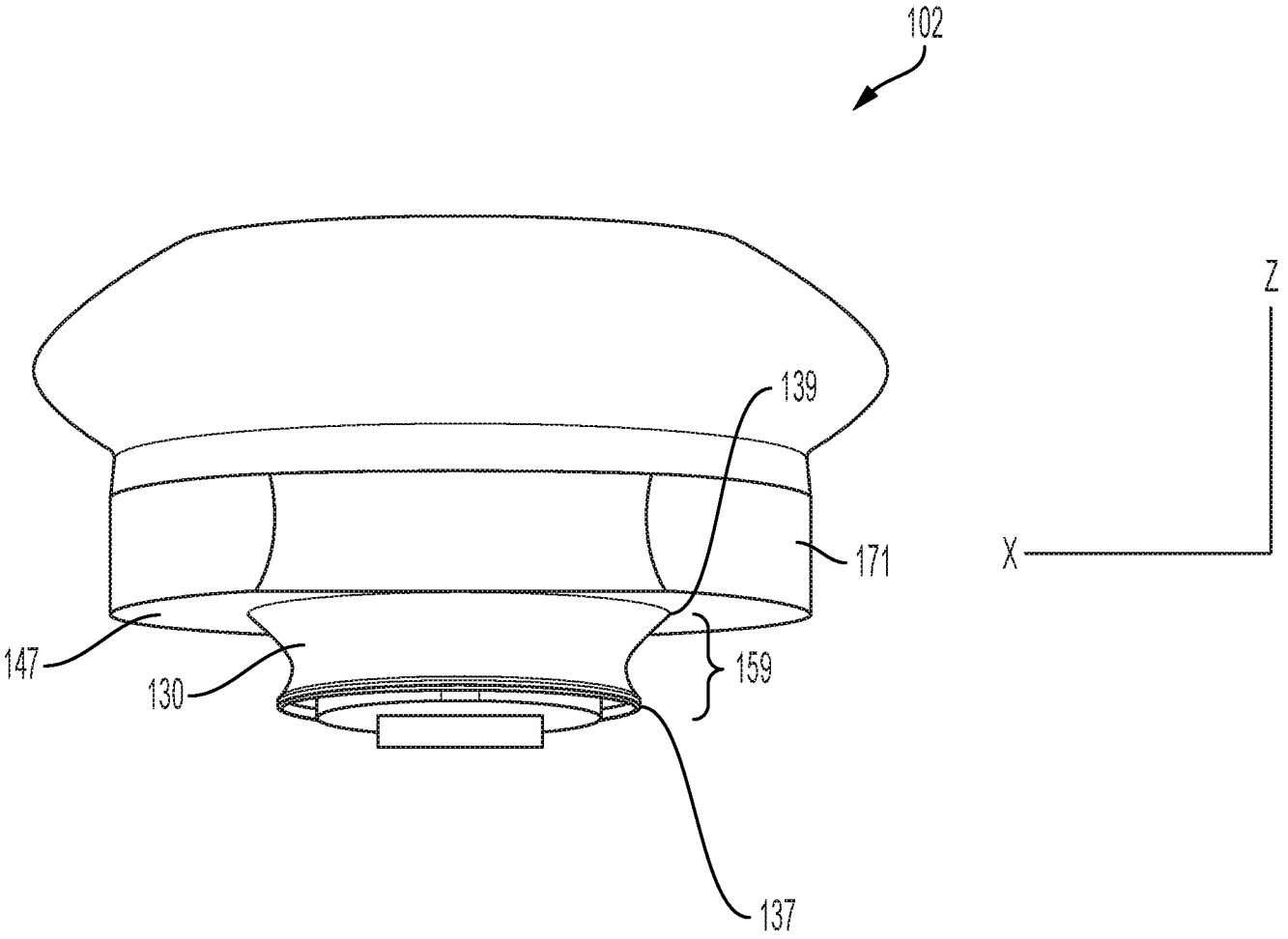
FIG. 1D shows a rear view of the cup of FIG. 1A.

FIG. 1D shows a rear view of the cup 102 of FIG. 1A. The buckle region wall 130 is in view with a first edge 139 and a second edge 137. First edge 139 is an upper exterior edge and second edge is a lower exterior edge ("exterior" is only used to denote that these edges are on the exterior of the cup, rather than interiorly inside the cavity). "Upper" and "lower" are used in describing in the orientation shown, but not mean to be limiting. Buckle region wall 130 protrudes from the underside 147 of the anchor wall 171 of cup 102, and forms the protrusion 159. Anchor wall 171 has a wall thickness larger than the wall thickness of buckle region wall 130.

Figure 1E:
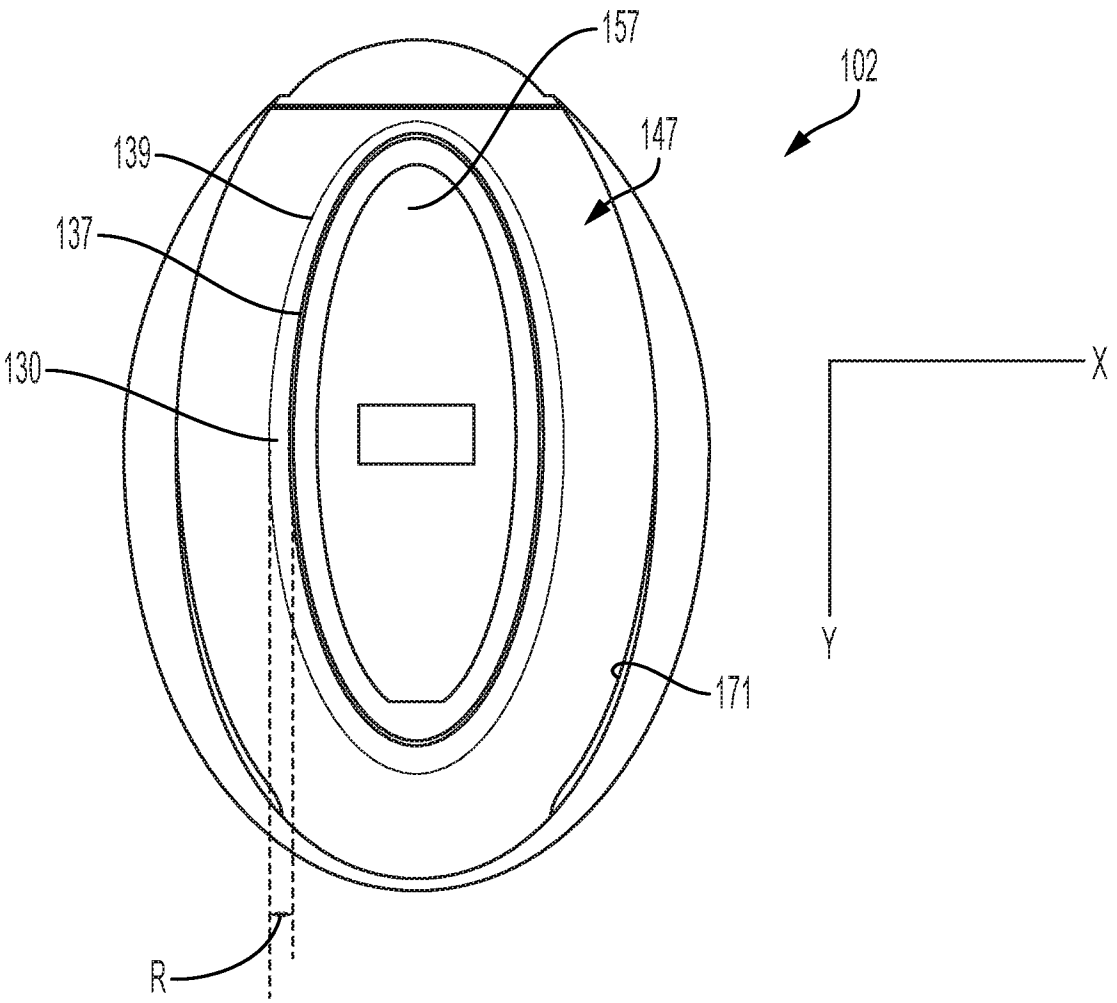
FIG. 1E is a bottom-up view of the cup of FIG. 1A.

FIG. 1E is a bottom-up view of the cup 102 of FIG. 1A. The buckle region is in view with the first edge 139 and the second edge 137 shown. A reveal R between edges 137 and 139 is configured to assist the buckle region wall in buckling under a compression force (also referred to herein interchangeably with "push force") from a driver. The buckling of buckle region wall 130 typically occurs prior to any warping of anchor wall 171. In some embodiments, the anchor wall 171 does not buckle or warp. In some embodiments, the anchor wall 171 does not substantially buckle or warp. The buckle region wall 130 is also configured such that it will spring back out to default (i.e. extended/relaxed) position when the compression force is removed. The reveal "R" is the difference in the X and Y dimensions, between the edge 137 and the edge 139, as indicated in FIG. 1B, FIG. 1C, and FIG. 1E. In the embodiment shown, R is equal around the perimeters of edges 137 and 139. In other embodiments, R could have some irregularities.

In some embodiments, the buckle region wall 130 is concave in shape on its exterior surface. Thus, in some embodiments, the buckle region wall 130 has a concave exterior surface. In some embodiments, the first edge 139 is of a larger perimeter than the second edge 137. This creates the reveal R. In embodiments, the oval shape outlined by the second edge 137 is oriented concentrically with respect to the oval shape outlined by the first edge 139. In some embodiments, the buckle region wall 130 is formed with an oval shape as shown in FIG. 1E. In some embodiments, the buckle region is of a shape other than an oval. Any suitable shape is included within the scope of the invention.

The buckle region wall 130, with reveal R, is also configured such that it will spring back out to default (i.e. extended/relaxed) position when Vmax (maximum volume) is reached. The buckle region wall 130 is made of a material that allows the second edge 137 to be compressed towards the first edge 139 by a push force of a mechanical member of a driver toward Vmin (minimum volume). When then the push force is subsequently removed from the second edge 137, and instead the driver is pulling toward Vmax, the buckle region 137 quickly/abruptly returns to its default position (expanded position) with a spring-like motion. The buckle region behaves similar to a spring having a spring constant that causes the buckle region wall to abruptly return to its default position once the push force of the driver is removed. Thus, the thud force is a transfer of mechanical energy from the springing out of the buckle, which is imparted to the user through the cup. There is also very slight disengagement between the lifter slot and bearing as the cam rotates (discussed with respect to the driver herein)—rotating to compress and then again to return (These are the disruptions in the illustrated pressure curves in FIG. 1616). In some embodiments, this contributes to the "thud" force. In some embodiments, the driver is configured to vary a volume of the cavity in such a way that the varied volume is not larger than an initial volume.

The cup 102 (and, therefore, cavity lateral wall 112 and base 114) is preferably comprised of a non-permeable flexible resilient material. In some embodiments, the flexible resilient material has a Shore durometer value ranging from A5 to D30. In some embodiments, the flexible resilient material has a Shore durometer value ranging from A10 to D20. In some embodiments, the cup is comprised of silicone. In some embodiments, the cup is comprised of rubber, TPE, plastic, or other suitable material.

In some embodiments, cup 102 may be formed without attachment to a sheath (referred to herein interchangeably with "sleeve"), and is glued or otherwise attached to a housing of a pressure field stimulation device. In other embodiments, the cup 102 may be attached to a sheath as shown and described in U.S. patent application Ser. No. 16/569,722 in FIGS. 25-26 and paras. [0155]-[0158]. Such portions of said patent application are herein incorporated by reference where not inconsistent with the disclosure herein.

Figure 2B:
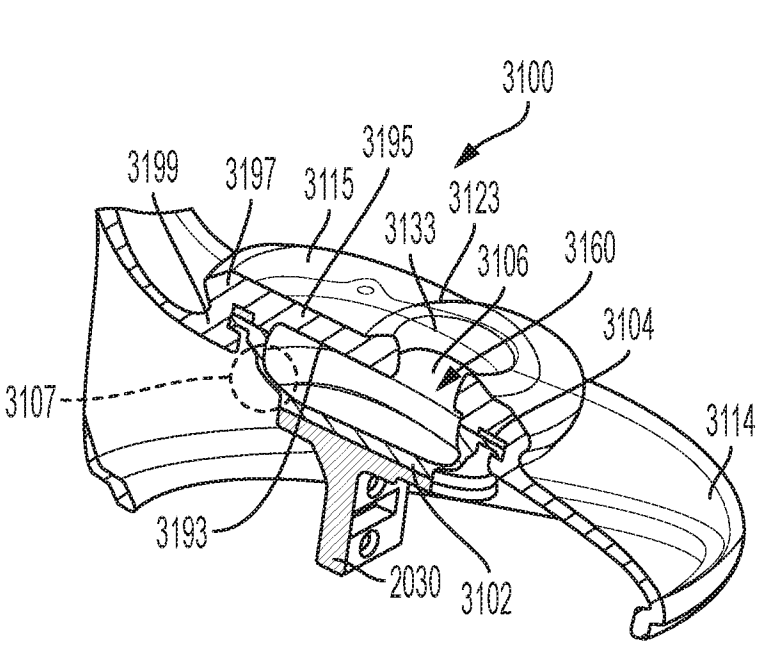
FIG. 2B shows a perspective cutaway view indicating details of a cup in accordance with disclosed embodiments.
Figure 2A:
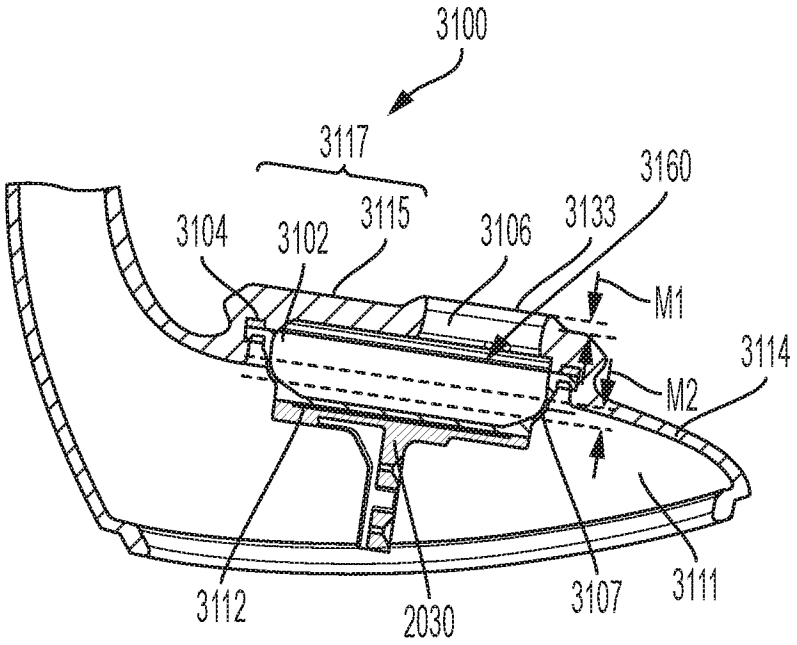
FIG. 2A shows a side cutaway view indicating details of a cup in accordance with disclosed embodiments.
Figure 3:
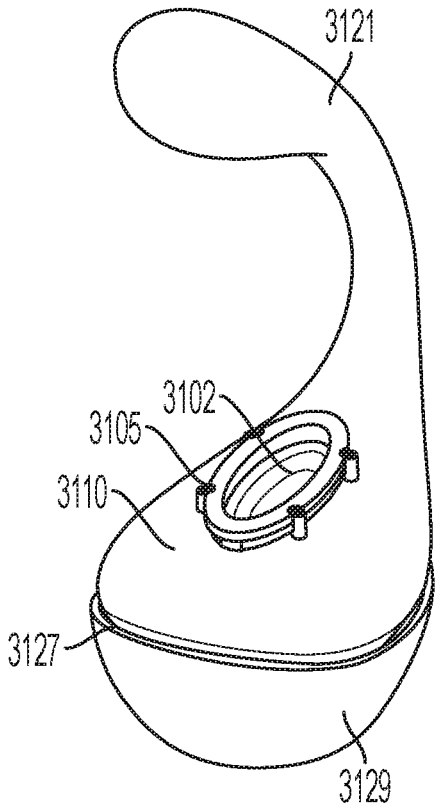
FIG. 3 shows a perspective view of an embodiment of the invention without the outer cup portion, ring, or sleeve/sheath thereon.

FIG. 2A and FIG. 2B show views of another cup assembly 3100 in accordance with some embodiments. For clarity, the housing is not shown in these figures. In some embodiments, the cup is comprised of an outer portion 3115 and an inner portion 3102. FIG. 2A shows a side cutaway view and FIG. 2B shows a perspective cutaway view. Referring now to FIG. 2A, the inner cup portion (referred to herein interchangeably with "diaphragm") 3102 is disposed within an interior 3111 of the housing 3110 (FIG. 3). In some embodiments, outer cup portion 3115 is integral (or, one piece with sleeve/sheath 3114). A chamber 3160 is formed by the outer cup portion 3115 and inner cup portion 3102 inside cavity 3106. Outer cup portion 3115 has opening 3133 into chamber 3160. The outer cup portion 3102 and the inner cup portion 3115 together form a seamless interior to the chamber, such that air can only be introduced or escape via the opening 3133.

In embodiments, a rigid plate 3112, as shown in FIG. 2A, is disposed below the inner cup portion 3102 to provide additional rigidity. Plate 3112 is not in view in FIG. 2B. In embodiments, rigid plate 3112 may be comprised of a hard plastic, metal, or other suitable material. In some embodiments, rigid plate 3112 may comprise aluminum or an aluminum alloy, or another suitable material. In some embodiments, the inner cup portion 3102 and outer cup portion 3115 are comprised of silicone. In some embodiments, the inner cup portion 3102 and outer cup portion 3115 are comprised of rubber, TPE, plastic, or other suitable material. The inner cup portion 3102 and outer cup portion can, but do not have to be made of the same material. In some embodiments, the plate is not present.

In some embodiments, the rim 3123 around the opening 3133 to cavity 3106 is formed, is raised a distance M1 as compared to the other rest of the outer portion 3115 of the cup, noted generally as 3117. In some embodiments, the distance M1 is a value ranging from 1.8 millimeters to 3.0 millimeters.

Inner cup portion 3102 has a buckle region 3107. Buckle region 3107 is convex on the exterior, which is different from the concave buckle region shown in the embodiment of FIGS. 1A-1E. During operation, buckle region 3107 of the inner cup portion 3102 buckles and/or flexes by a distance M2 due to the reciprocal motion of the lifter 2030 during operation. In some embodiments, distance M2 may range from 1.5 millimeters to 5.5 millimeters. In some embodiments, distance M2 may range from 1.5 millimeters to 6 millimeters.

Figure 2C:
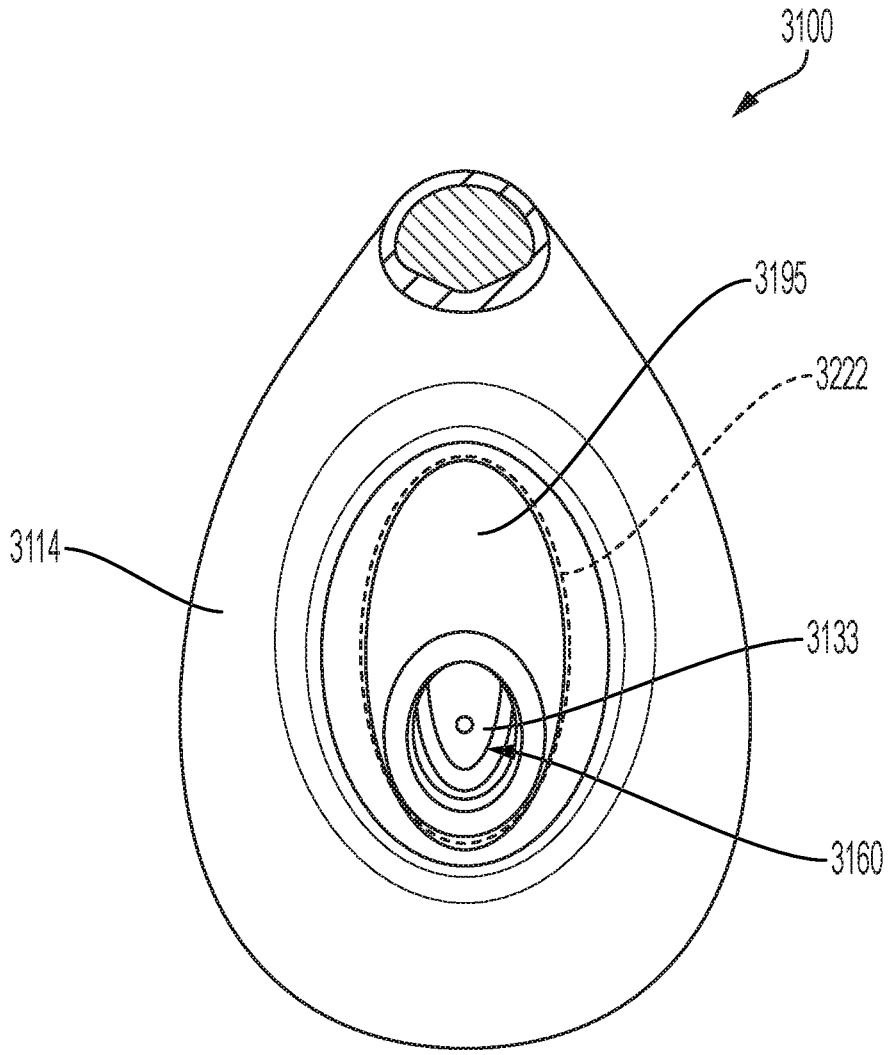
FIG. 2C shows a partial top-down view of the embodiment of FIGS. 2A and 2B.

Referring now to FIG. 2B, there can be seen the ring 3104 that holds the outer cup portion 3115 to the housing 3110 (FIG. 3) above inner cup portion 3102. The outer cup portion 3115 is held by friction fit, glue, reciprocal grooves and indentations, or other suitable mechanism. Ring 3104 can be made of a rigid material, such as plastic, metal, or another suitable material. The outer cup portion 3115 has a top 3195, which extends to inflection point shown generally as 3197 to cup outer side walls 3199. Inflection point 3197 extends around the entire width of the cavity (so the cup top 3195 extends between "inflection points", except where the opening is. Note that inflection point does not mean that there is a break in the material, but in some cases, there can be. Accordingly, it can also be called a "junction point" in some cases. In the example shown, the top surface and side walls 3199 are made of the same substantially contiguous material without a break in between. Top surface 3195 has an underside 3193, which is inside the cavity, opposite the top surface 3191. Region 3107 of the inner cup portion 3102 is the buckling region that is designed to buckle and/or flex to create changes in volume, and thereby, pressure within the cup during operation as the lifter 2030 moves in a reciprocal motion. The change in pressure during operation can create a pleasurable sensation for the user. "Top" used herein relating to the cup is not meant to be limiting. As consistent with the traditional usage of the word "cup," the "top" is the portion which is open or has an opening therein. FIG. 2C shows a partial top-down view of the embodiment 3100 of FIGS. 2A and 2B. Reference number 3222 reflects the outline of the perimeter defining the width of the cavity under the cup top 3195.

Figure 5:
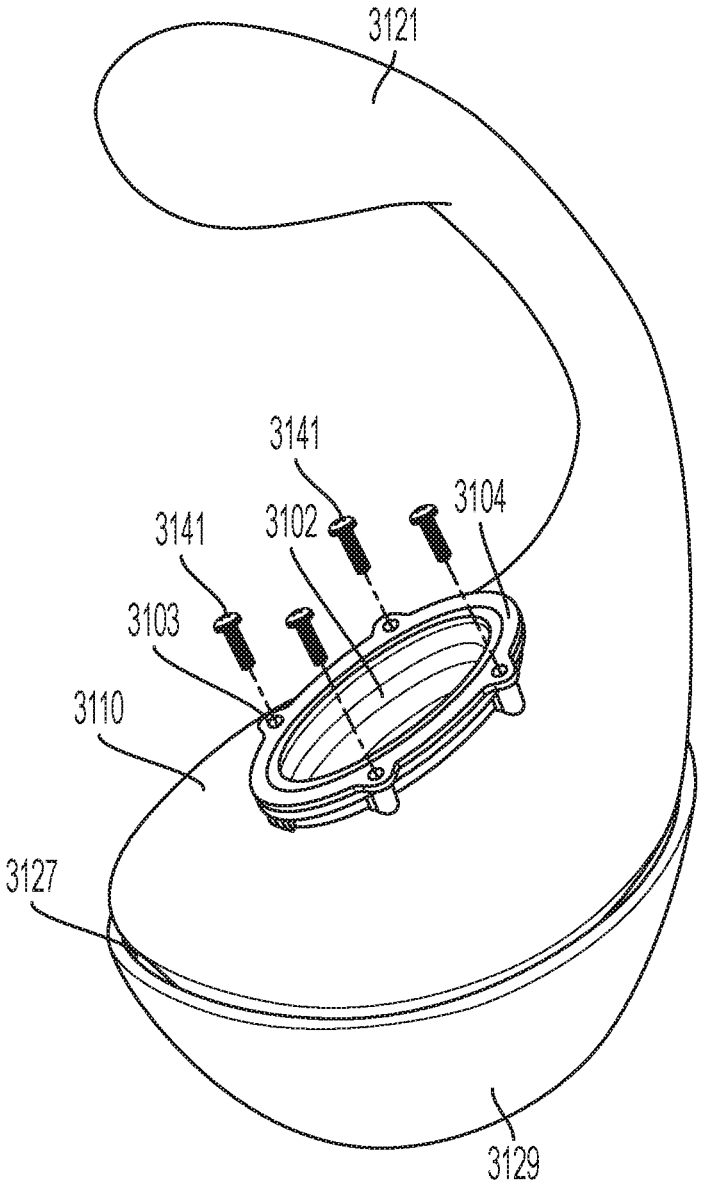
FIG. 5 shows a top-down side view of a pressure field stimulation device in accordance with some embodiments of the invention without the outer cup portion and sleeve shown.

FIG. 3 shows a perspective view of an embodiment of the invention without the outer cup portion, ring, or sleeve/sheath thereon. Housing 3110 is in view with holes 3105 disposed thereon to hold the ring 3104 to housing 3110 (FIG. 5). Inner cup portion 3102 is in view. Attachment point 3127 is shown where a sleeve/sheath can interface and attach to the housing 3110.

In the embodiment, shaft 3121 is included on the device. Shaft 3121 may be sized and configured for insertion into a user's vagina or anus. In some embodiments, there is a vibrator, oscillator, pulsator, gyrator, mechanical apparatus creating a "come hither" motion, or other suitable mechanism for additional stimulation.

Figure 4C:
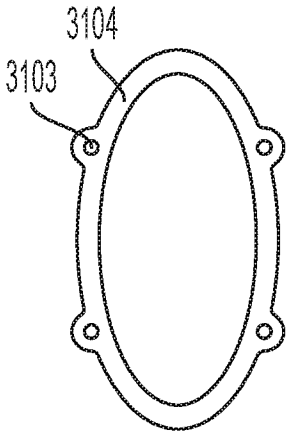
FIG. 4C shows a bottom-up view of the ring.
Figure 4B:
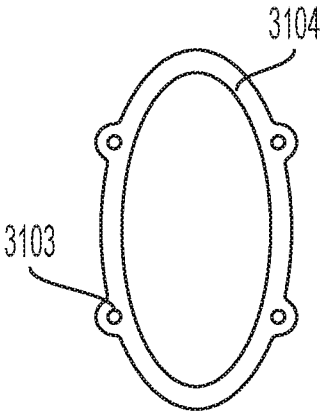
FIG. 4B shows a top-down view of the ring.
Figure 4A:
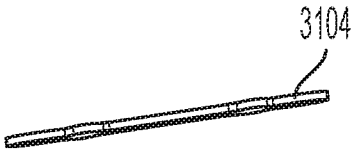
FIG. 4A shows a side view of a ring.

FIG. 4A shows a side view of the ring 3104. FIG. 4B shows a top-down view of the ring 3104. FIG. 4C shows a bottom-up view of the ring 3104. Four screw holes 3103 are shown. In embodiments, more or fewer screw holes (and screws) can be included as feasible.

FIG. 5 shows a top-down side view of a pressure field stimulation device in accordance with some embodiments of the invention without the outer cup portion and sleeve shown. Housing 3110 is in view with ring 3104. Holes 3103 are disposed in the ring 3104 for screws, examples of which are represented at 3141, to hold the ring 3104 to housing 3110. Inner cup portion 3102 is in view.

Figure 6B:
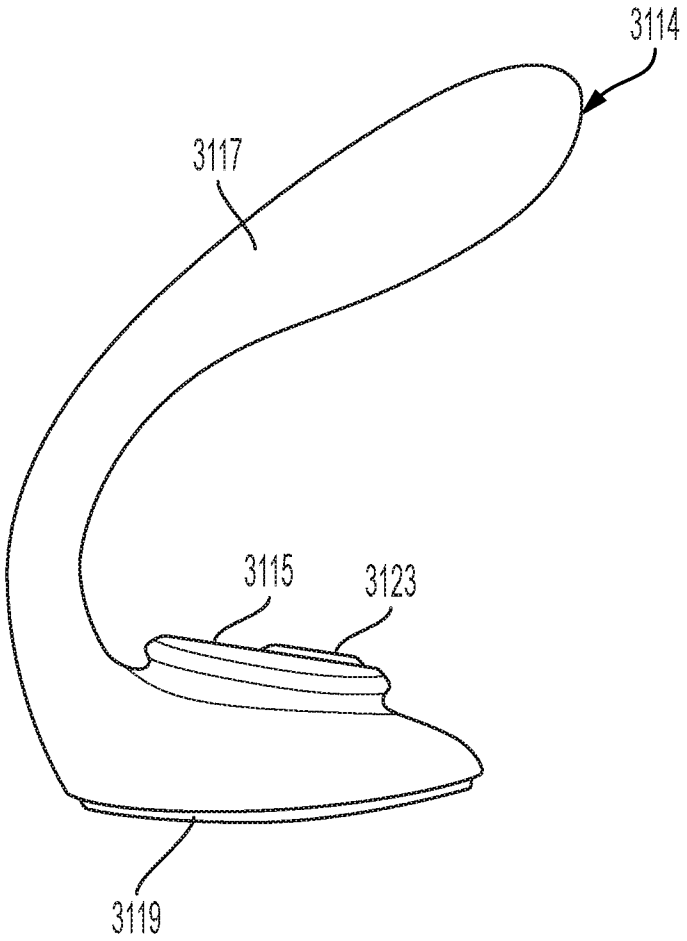
FIG. 6B shows a side view of a sleeve.
Figure 6A:
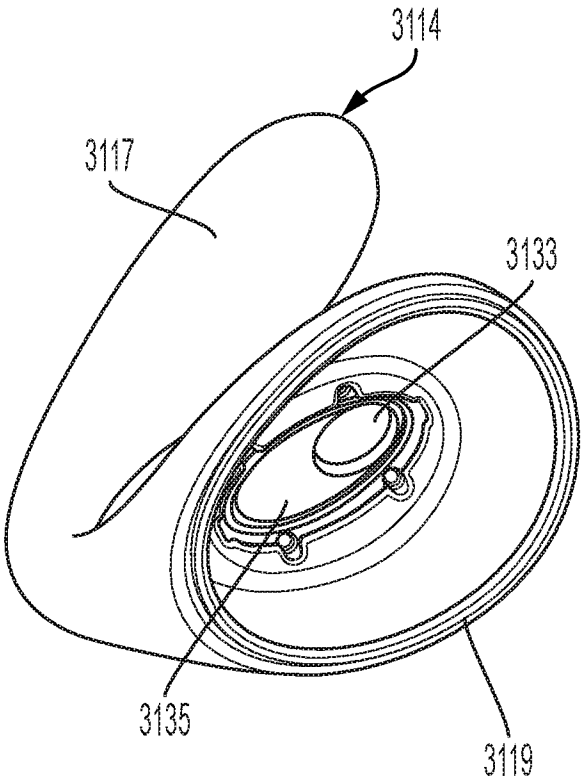
FIG. 6A shows a bottom-up view of a sleeve.

FIG. 6A shows a bottom-up view of a sleeve 3114 with outer cup portion 3115 formed together as a single piece of material, illustrating the interior of the sleeve. FIG. 6B shows a side view of sleeve 3114. The sleeve 3114 is flexible, resilient, and elastic. In some embodiments, it includes a shaft portion 3117 for extending over shaft 3121 (FIG. 3). The sleeve stretches over the housing 3110 of embodiments, attaching at attachment point 3127 (FIG. 3), with a tight fit. Underside 3135 of outer cup 3115, as well as opening 3133, is in view in FIG. 6A.

In some embodiments, the sleeve 3114 is made of silicone, rubber, TPE, or plastic. In some embodiments, the sleeve 3114 is made of a flexible and elastic material. "Elastic material" herein is a material that is expandable by force, but returns to its original size when the force is removed. This is such that it can stretch to fit snugly over housing 3110, and shaft 3121, if present. In some embodiments, the sleeve is not needed to be flexible, or not present at all. In some embodiments, the outer cup portion 3115 is monolithic with the sheath 3114. The outer cup portion 3115, in some embodiments, is molded into the sheath as a single piece. In such embodiments, the outer cup portion and sheath may be injection molded via a single mold such that the resulting cup-sheath is a single piece and not made of two pieces. Thus, in embodiments, the covering of the cup, shaft, and other portion of the housing is formed as an integrated piece of elastic material. Note that injection molding is an example process, and any suitable method of making is included within the scope of the invention.

An attachment point 3127 is formed around the base portion 3129 of housing 3110 (FIG. 3). In some embodiments, attachment point 3127 on the base portion is an indentation, and a corresponding attachment point 3119 of the sleeve 3114 is a protrusion. They can fit together via friction fit, glue, or other suitable mechanism. This is an example, and the sheath 3114 may be attached to the shaft or housing 3110 in any suitable way. In some embodiments, it may be via reciprocal grooves and protrusions on the shaft or base housing, and sheath, noted as attachment point on the sheath. The sheath may be adhered to the shaft/housing instead or in addition to reciprocal grooves and protrusions.

Figure 7A:
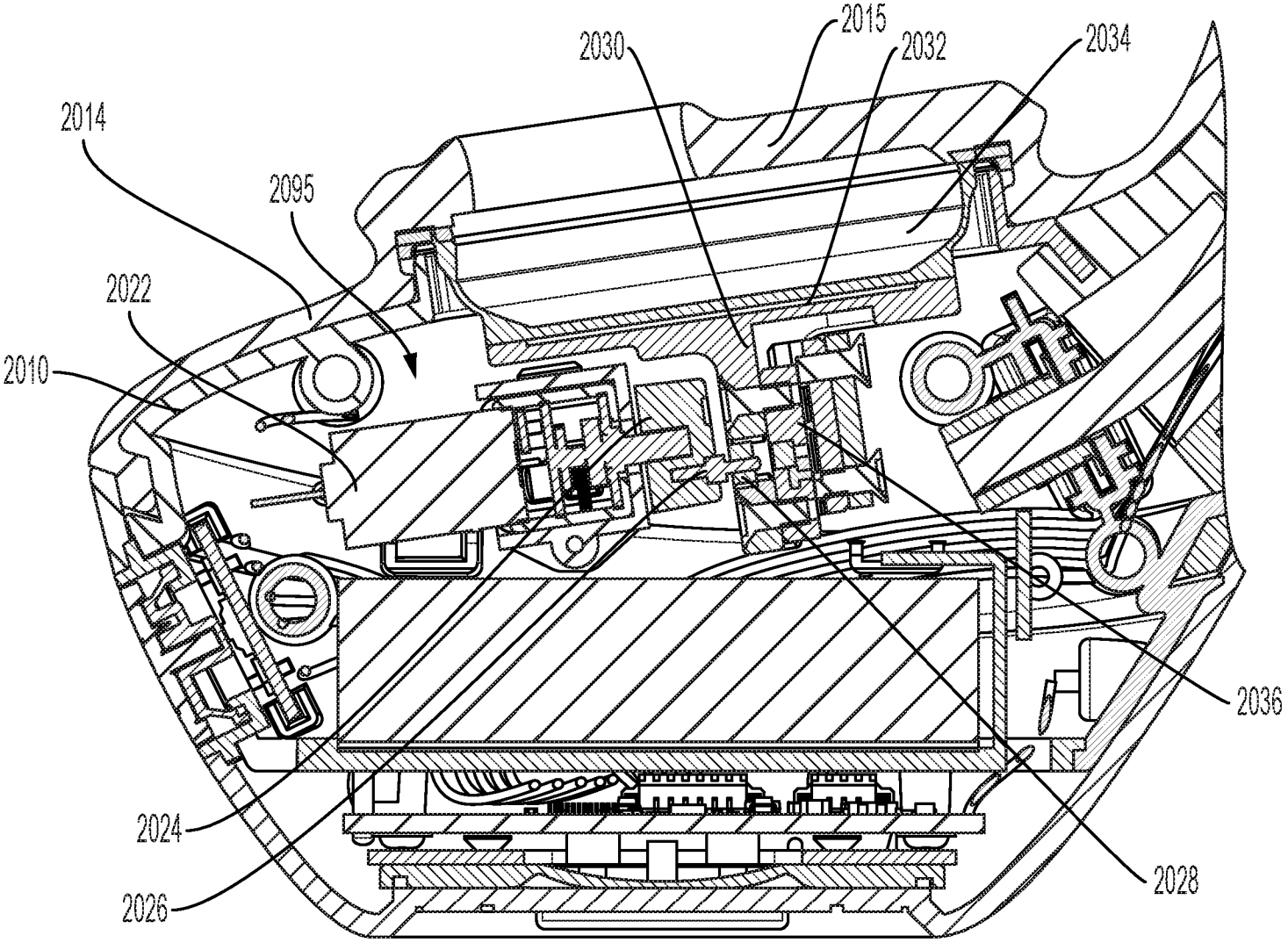
FIG. 7A shows a cutaway view of driver components.

FIG. 7A shows a cutaway view of driver components, in addition to cup and sleeve components, of the pressure field stimulation device. The driver 2095 includes an electric motor 2022 that is configured and disposed to rotate a cam 2024. The cam 2024 has a cam pin 2026 protruding therefrom. A bearing 2028, which in some embodiments is a roller bearing as shown herein, is disposed on a distal end of the cam pin 2026. The cam pin 2026 is mechanically coupled to the bearing 2028. The roller bearing 2028 fits in a slot on the lifter 2030. The lifter 2030 is mechanically coupled to a rigid plate 2032. The rigid plate 2032 is mechanically coupled to the cup diaphragm 2034. In some embodiments, a non-rigid plate may be used in place of rigid plate 2032. The mechanism of the cam 2024, cam pin 2026, bearing 2028, and lifter 2030 convert rotational motion of the motor 2022 to a linear "up and down" motion for cyclically altering the volume, and thereby pressure, in the cup diaphragm 2034. To further stabilize and smooth the linear motion, a linear bearing 2036 is mechanically coupled to the lifter and configured and disposed to guide the motion of the lifter. The linear bearing constrains motion along a line, such that the lifter 2030 is constrained to only move along that line in a reciprocating manner. The linear bearing is shown in additional detail in FIG. 7B.

In some embodiments, the cam 2024 may be comprised of Polyoxymethylene (POM), aluminum, steel, or other suitable material. In some embodiments, the cam pin 2026 can be comprised of steel, plastic, a combination of steel and plastic, or other suitable material(s). In some embodiments, the roller bearing 2028 may be comprised of steel, plastic, a combination of steel and plastic, or other suitable material (s). In some embodiments, the linear bearing 2036 may be comprised of plastic, steel, a combination of steel and plastic, or other suitable material(s). In some embodiments, the rigid plate 2032 may be comprised of steel, plastic, and/or other suitable material(s).

Also in view are outer cup portion 2015 is in view, as well as sleeve 2014. Sleeve 2014 is disposed on housing 2010. Sleeve 2014 is attached to the housing 2010 either by friction fit, glue, reciprocal grooves and indentations, or other suitable mechanism.

Figure 7B:
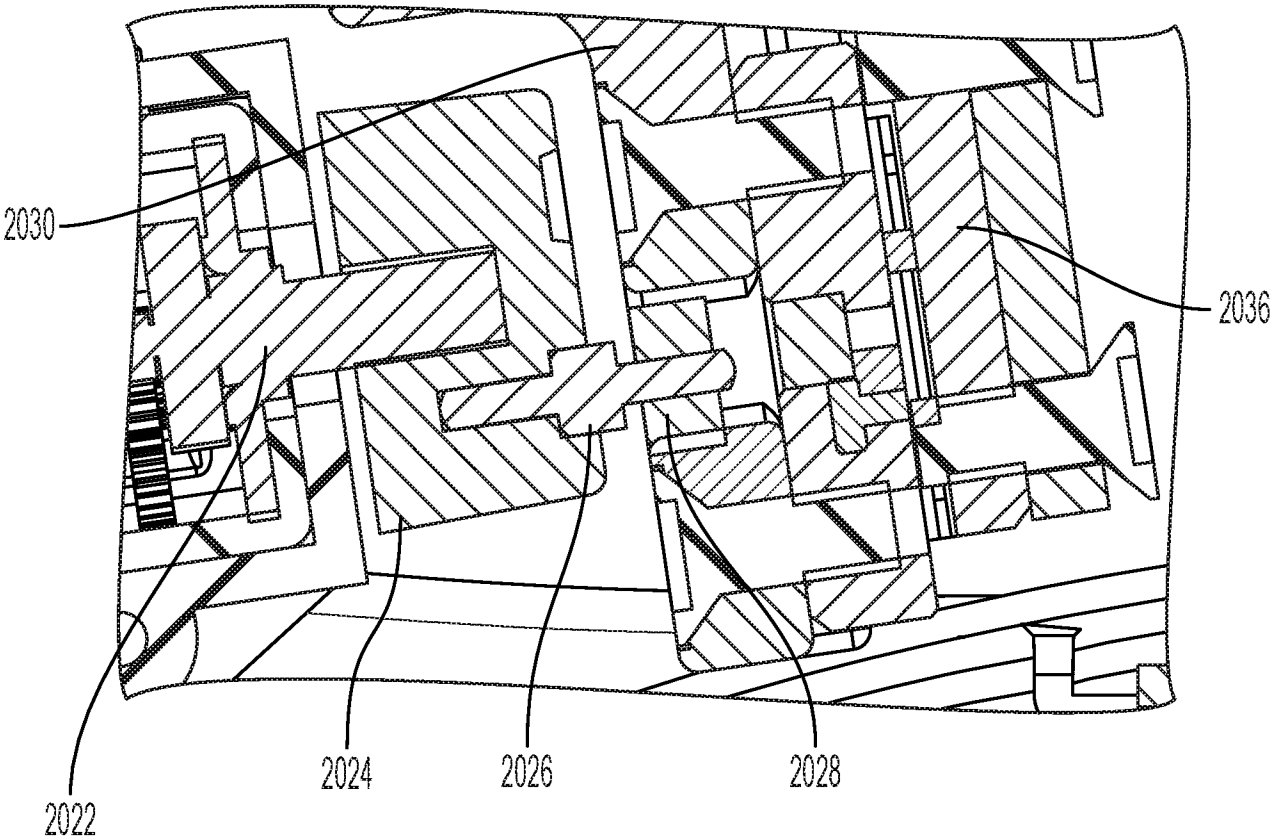
FIG. 7B shows additional details of the pressure field stimulation device.

FIG. 7B shows a diagram of additional details of the pressure field stimulation device indicating the linear bearing. As can be seen in FIG. 7B, the mechanism of the cam 2024, cam pin 2026, roller bearing 2028, and lifter 2030 convert rotational motion of the motor 2022 to a linear "up and down" motion, and the roller bearing 2028 serves to reduce friction, noise, and unwanted vibration of the mechanism. The linear bearing 2036 is mechanically coupled to the lifter to guide the motion of the lifter in a smooth motion that reduces noise and vibration.

Figure 8:
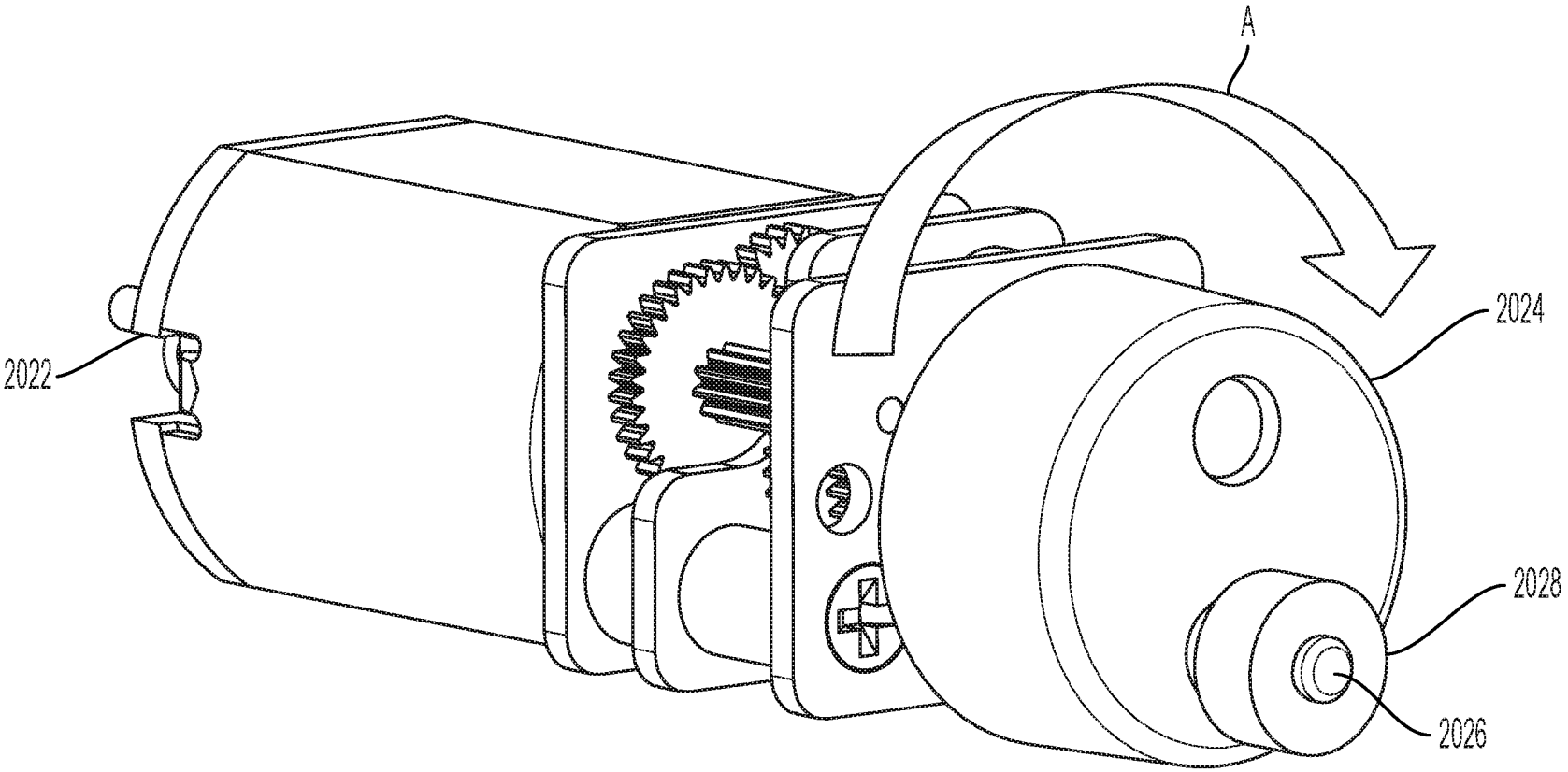
FIG. 8 shows a detailed view of the motor with a mechanically coupled cam.

FIG. 8 shows a detailed view of the motor 2022 with mechanically coupled cam 2024. As the motor 2022 operates, it induces rotation in the cam 2024 as indicated by arrow A. Cam pin 2026 is affixed to the cam 2024. The roller bearing 2028 is rotatably affixed to the cam pin 2026. The roller bearing 2028 reduces unwanted noise and vibration during operation of the pressure field stimulation device. In testing with some embodiments, taking sound measurements from 20 centimeters away from such embodiments, noise levels have been reduced from 78 decibels to 65 decibels as compared with prior art devices.

Figure 9B:
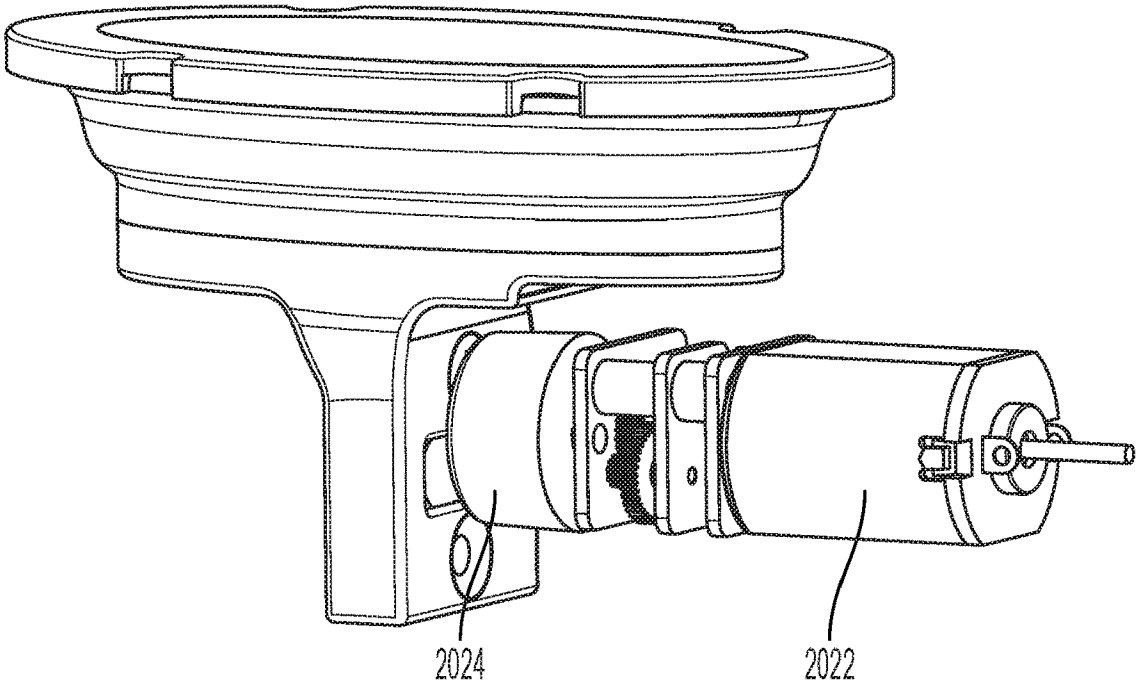
FIG. 9B shows a side view of the cup, including the cam and lifter.
Figure 9A:
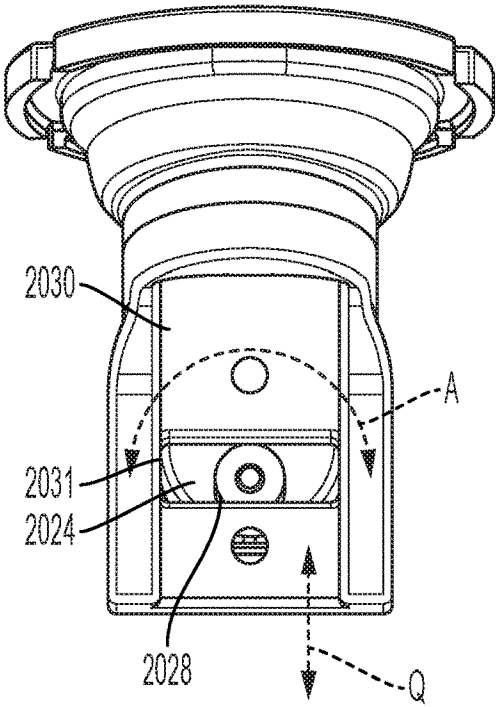
FIG. 9A shows a front view of the cup, including the cam and lifter.

FIG. 9A and FIG. 9B show views of the roller bearing 2028 installed in the lifter. As the motor 2022 operates and causes the cam to rotate in the direction(s) indicated by arrow A, the roller bearing 2028, engaged in lifter slot 2031, moves the lifter in the vertical direction as indicated by arrow Q. In some embodiments, the cam 2024 may rotate continuously in a clockwise or counterclockwise direction. In other embodiments, the cam 2024 may change the direction of rotation during operation.

Figure 10:
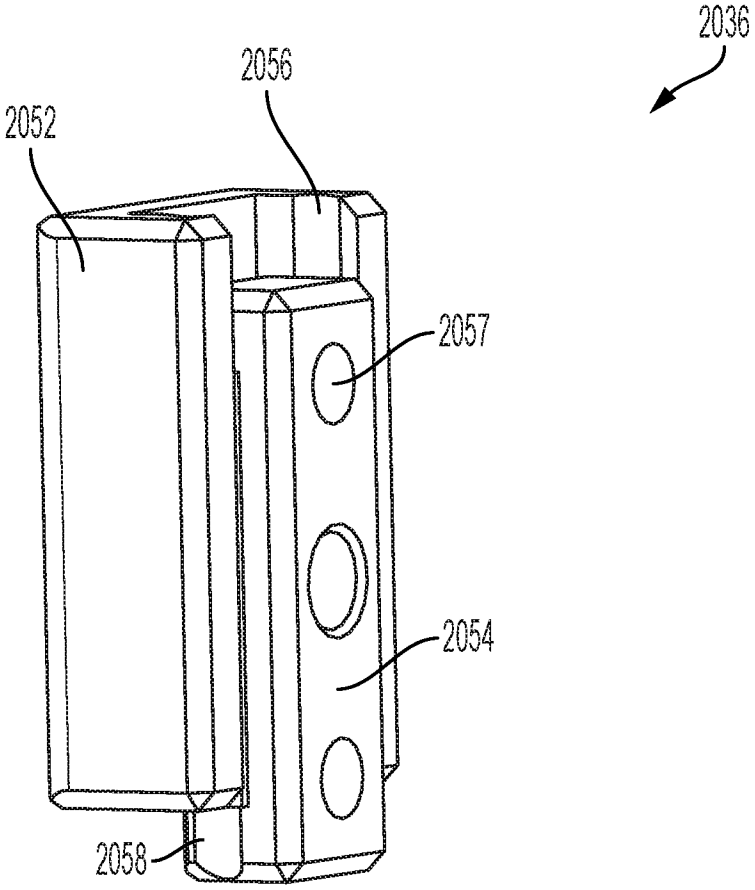
FIG. 10 shows details of the linear bearing.

FIG. 10 shows details of the linear bearing 2036. Linear bearing 2036 includes a fixed block 2052 and a sliding block 2054. In embodiments the fixed block 2052 may be mounted to an interior wall of the housing, or other mount point, of the pressure field stimulation device, so as to remain stationary relative to the sliding block 2054. The sliding block 2054 includes one or more mounting holes, indicated generally as 2057, to enable the sliding block 2054 to be affixed to the lifter 2030 (FIG. 9A). Grooves 2056 in the fixed block are engaged by flanges 2058 in the sliding block to form a fit with minimal play, allowing smooth linear travel to improve operation of the pressure field stimulation device. In some embodiments, the grooves 2056 may further include ball bearings to allow smooth linear motion. In some embodiments, the fixed block 2052 and sliding block 2054 may each be made of metal such as steel, or plastic, a combination thereof, or other suitable material. Linear bearing 2036 looks symmetrical to what is shown when viewed from the opposite direction.

Figure 11A:
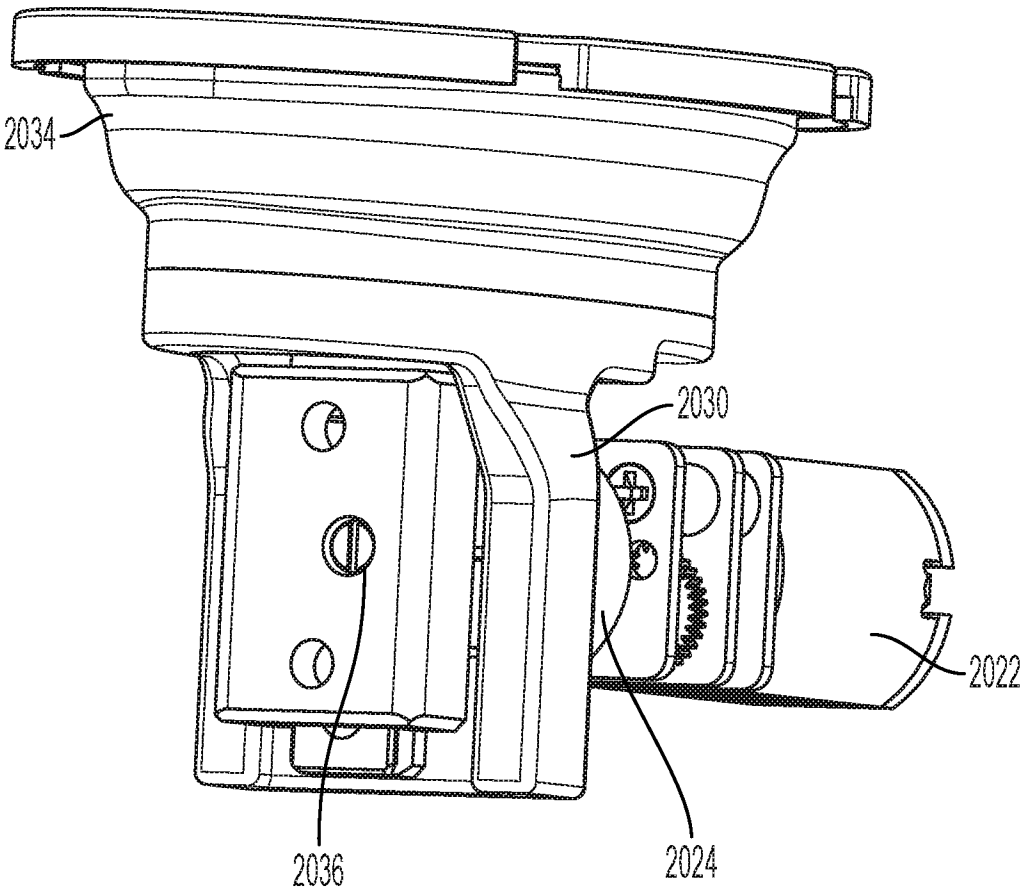
FIG. 11A shows a perspective view of pressure field stimulation device components in accordance with embodiments of the present invention.
Figure 11B:
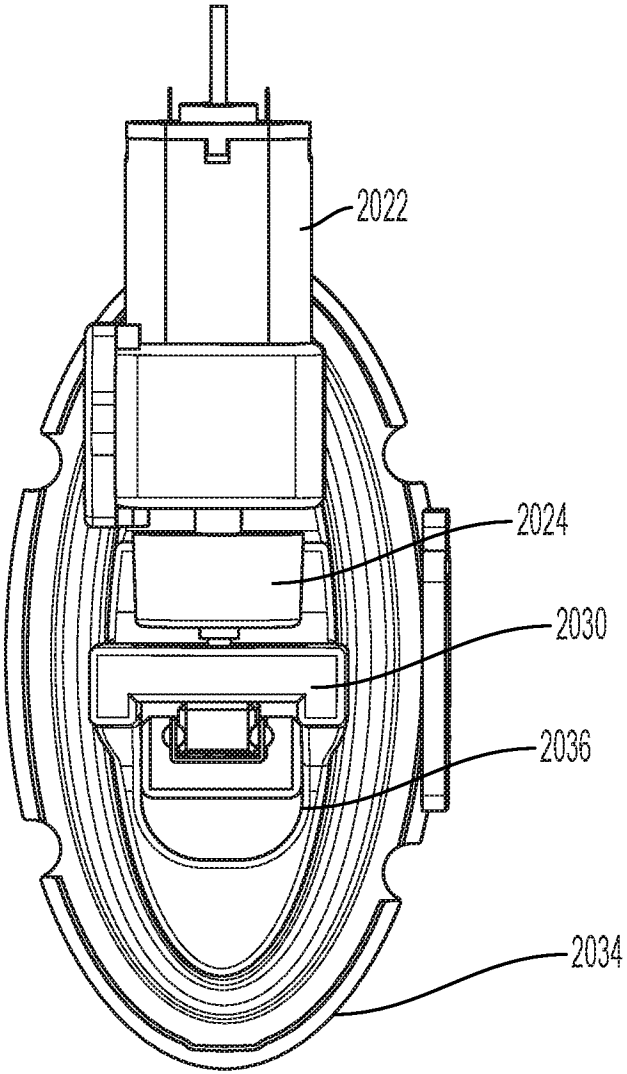
FIG. 11B shows a bottom-up view of the pressure field stimulation device components shown in FIG. 11A.
Figure 11C:
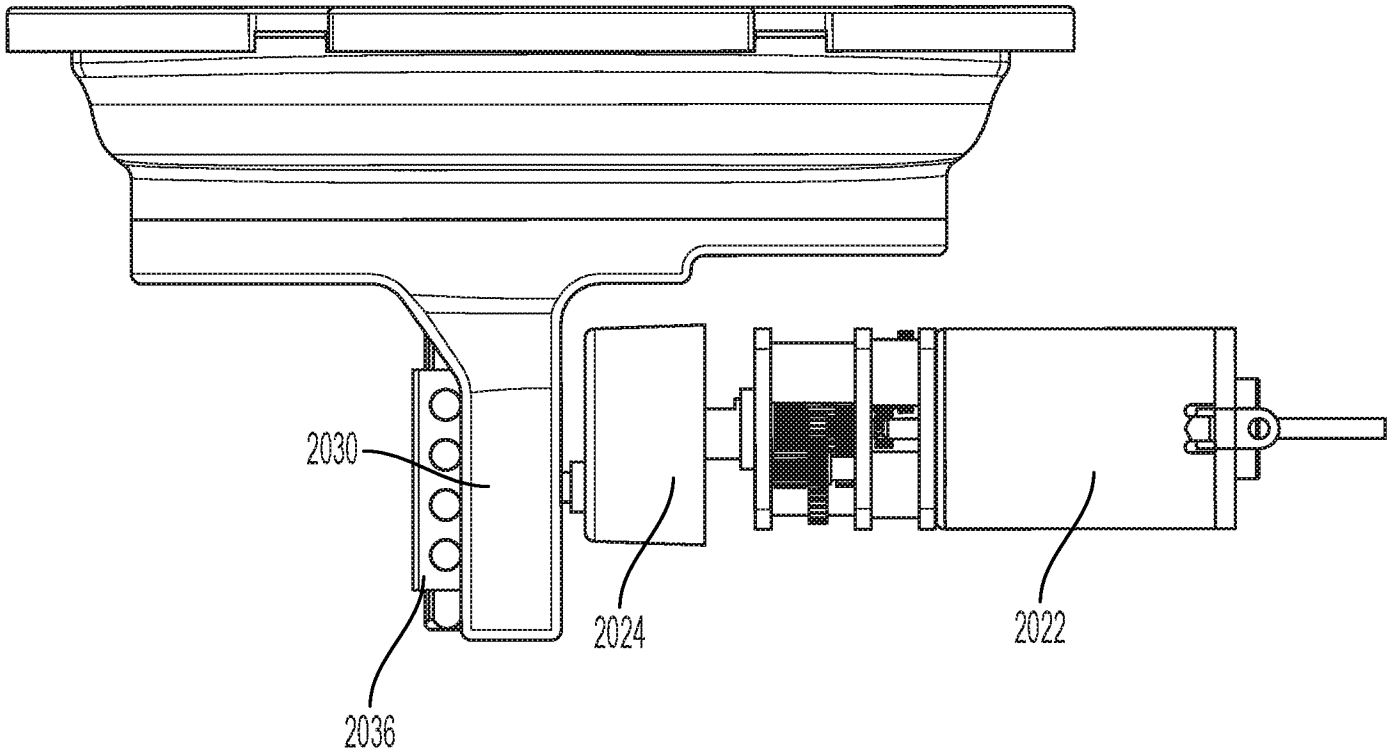
FIG. 11C shows a side view of pressure field stimulation device components of FIG. 11A.

FIG. 11A shows a perspective view of pressure field stimulation device components in accordance with embodiments of the present invention. FIG. 11B shows a bottom-up view of the pressure field stimulation device components shown in FIG. 11A. FIG. 11C shows a side view of pressure field stimulation device components of FIG. 11A. As can be seen in FIGS. 11A-11C, the motor 2022 operates to rotate the cam 2024, causing the lifter 2030 to travel back and forth in a linear motion (reciprocating), as guided by linear bearing 2036. This causes fluctuations in pressure within diaphragm 2034 that can create a pleasurable sensation for a user.

Figure 12B:
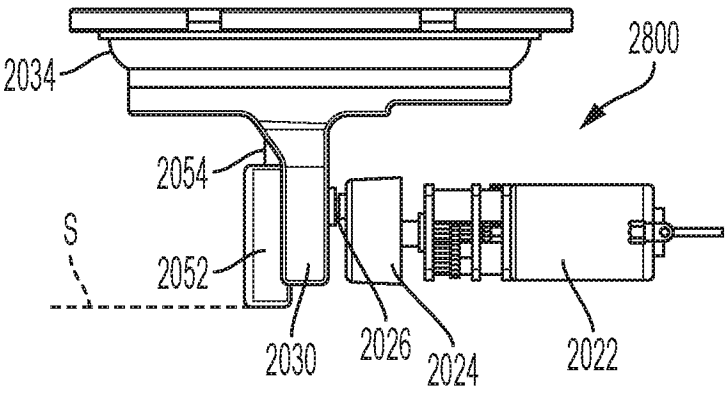
FIG. 12B shows a view of a driver in a maximum position.
Figure 12A:
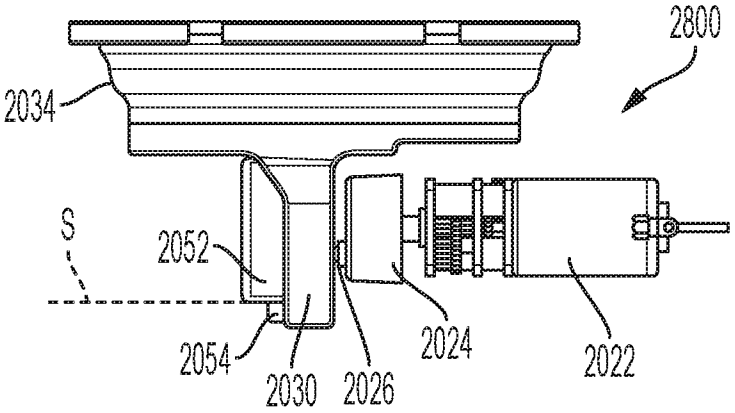
FIG. 12A shows a view of a driver in a minimum position.

FIG. 12A and FIG. 12B show an embodiment of the driver in different positions during operation. FIG. 12A shows driver 2800 in a minimum position where the motor 2022 has positioned the cam 2024 such that the cam pin 2026 is at its lowest position relative to the fixed block 2052, in which case, the cam pin 2026 is at its closest to line S during the operation cycle. This is Vmax, in which the inner cup (diaphragm 2034) is shown uncompressed. Line S represents the level of the base of the fixed block 2052. This forces the lifter 2030 to be in its lowest position relative to the fixed block 2052. The fixed block 2052 is stationary relative to the lifter 2030. The sliding block 2054 is affixed to the lifter 2030 and thus, moves with respect to the fixed block 2052 as the driver 2800 operates.

FIG. 12B shows driver 2800 in a maximum position where the motor 2022 has positioned the cam 2024 such that the cam pin 2026 is at its highest position relative to the fixed block 2052. This forces the lifter 2030 to be in its highest position relative to the fixed block 2052, in which case, the cam pin 2026 is at its furthest from line S during the operation cycle. This is Vmin, in which the inner cup portion 2034 (also referred to hereinabove as diaphragm 2034) is shown compressed or buckled. The fixed block 2052 is stationary relative to the lifter 2030. The sliding block 2054 is affixed to the lifter 2030 and thus, moves with respect to the fixed block 2052 as the driver 2800 operates.

As the driver operates, it moves the lifter 2030, and thus cup, or inner cup portion 2034, in a reciprocating motion. During operation, when a user has the outer cup portion 3115 (FIGS. 2A and 2B) (or cup 102) against skin, the cup or inner cup portion 2034 will buckle and compress, and decompress or expand, creating pressure changes that can create a pleasurable sensation for the user.

Figure 13:
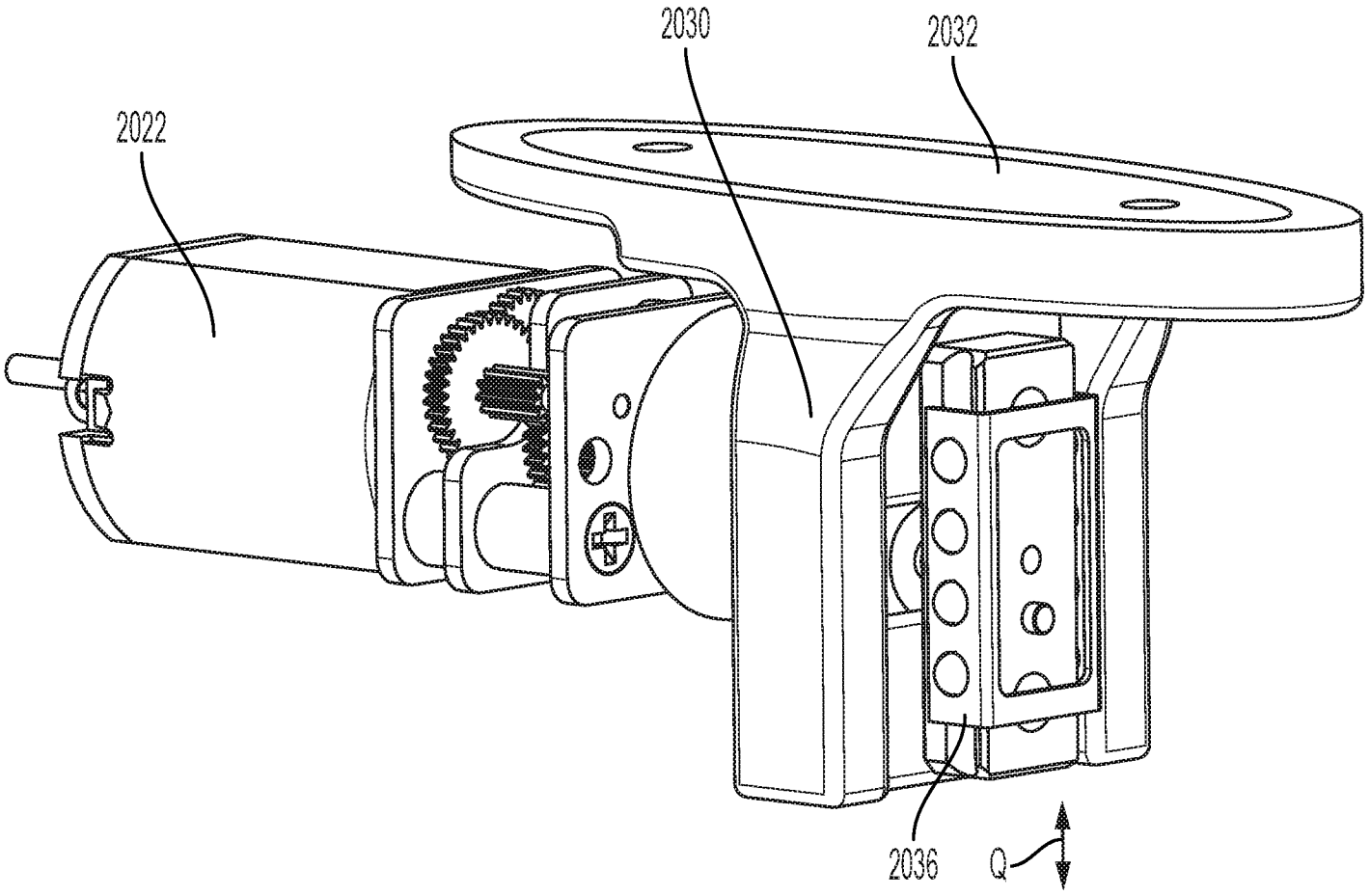
FIG. 13 shows another perspective view of pressure field stimulation device components in accordance with embodiments of the present invention.

FIG. 13 shows another perspective view of pressure field stimulation device components in accordance with embodiments of the present invention showing the linear bearing. In this view, it can be seen that the lifter 2030 is mechanically coupled to the linear bearing 2036 to enable smooth reciprocating linear motion in the direction indicated by arrow Q, as the motor 2022 operates. The rigid plate 2032 pushes against the diaphragm (2034 of FIG. 7A) to create a change in pressure within the chamber when the pressure field stimulation device is placed against the clitoral region of a user. Note that although embodiments are described as used for a clitoris, any suitable portion of skin or other body part can be substituted (such as the leg).

Figure 14:
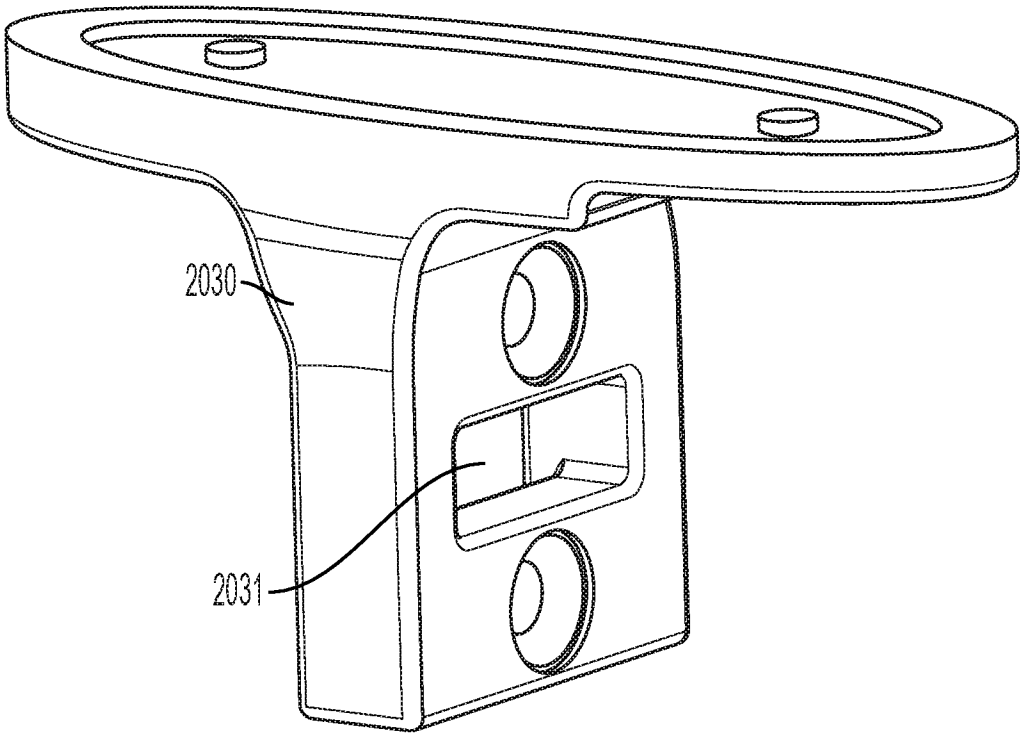
FIG. 14 shows a perspective view of the lifter.

FIG. 14 shows a perspective view of the lifter 2030. Formed within the lifter is a slot 2031. The slot 2031 is configured and disposed to engage with the roller bearing (2028 of FIG. 7A), such that as the cam (2024 of FIG. 7A) rotates and moves the roller bearing, it moves the lifter in a linear "back and forth" motion, guided by the linear bearing (2036 of FIG. 10).

Figure 15A:
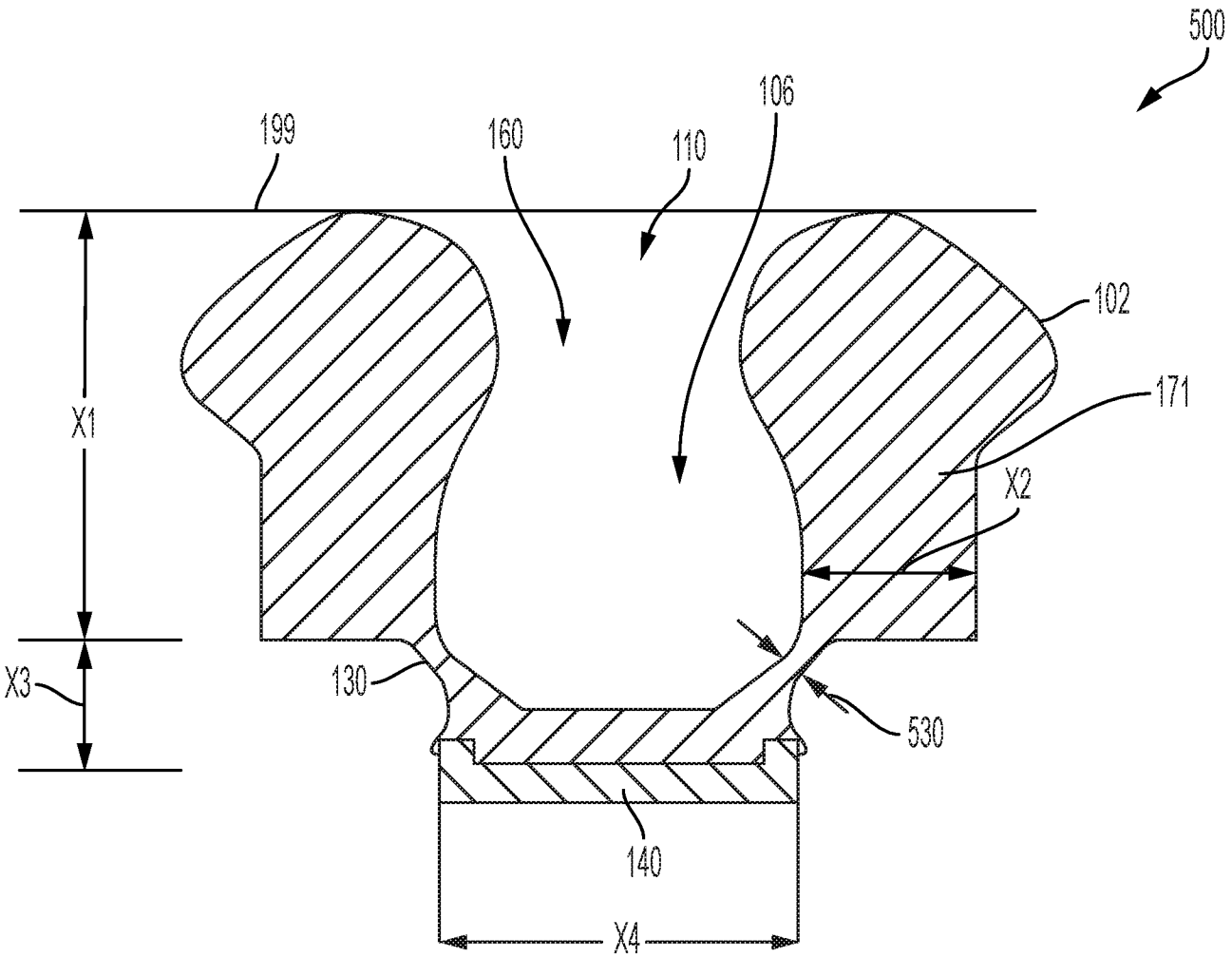
FIG. 15A shows a cross-section diagram of a cup and plate assembly in a default position against skin of a user.

FIG. 15A shows a cross-section diagram of a cup 102 (like FIGS. 1A-1E) and plate assembly 500 in default position against skin of a user. Buckle region wall 130 is shown in default position. Anchor wall 171 is in view. The material of the buckle region wall is "relaxed". In use, the user places the opening 110 of the cup 102 onto their skin 199. The skin 199 seals or substantially seals a cavity 106 to form a chamber 160.

Figure 15B:
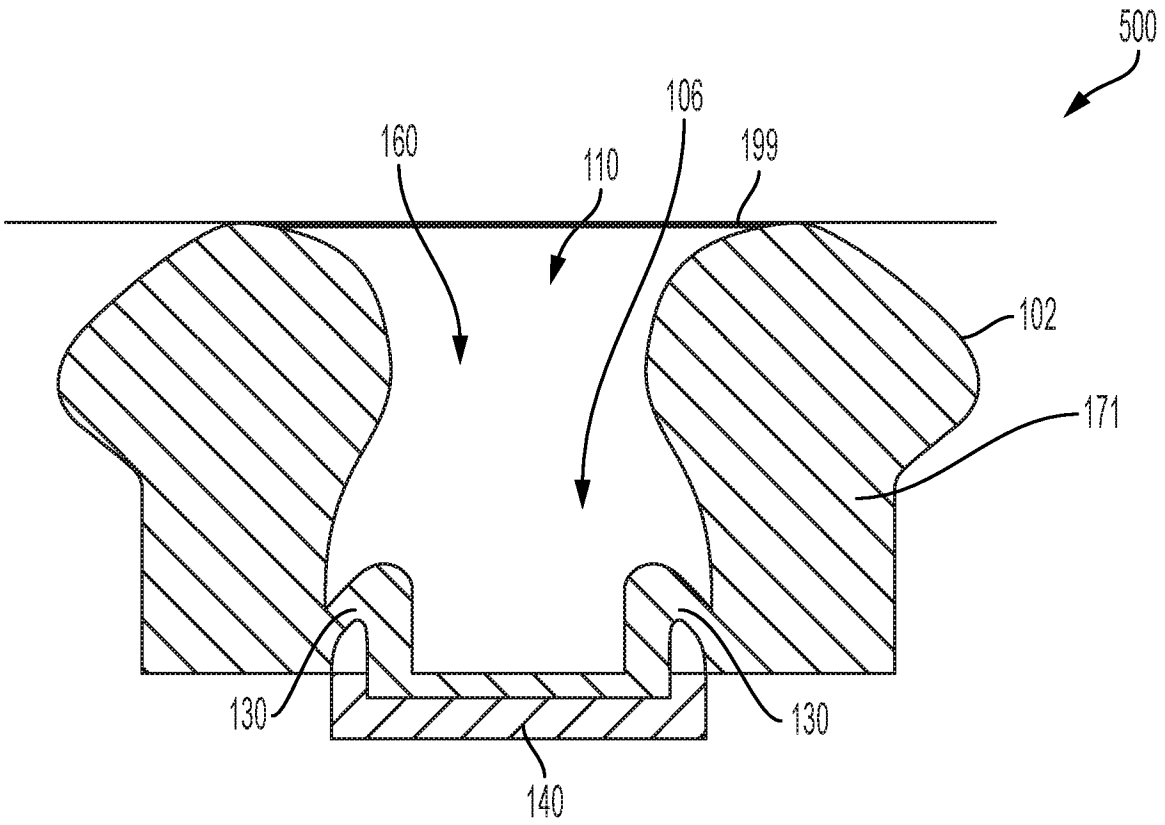
FIG. 15B shows a cross-section diagram of a cup and plate assembly in a compressed position against skin of a user.

FIG. 15B shows a cross-section diagram of a cup and plate assembly 500 of FIG. 10A in compressed position against skin 199 of a user. As shown, buckle region wall 130 is compressed due to push force placed on it by the driver through plate 140 (similar to plate 2032). Accordingly, the volume of the cavity 106 in FIG. 12B is different from the volume of the cavity 106 in FIG. 12A. Note that anchor wall 171 may buckle, or bend, in addition to the buckle region wall 130, in some embodiments. In such though, the buckle region wall 130 will buckle first.

As the stimulation device continues to operate from the compressed position shown in FIG. 15B, the buckle region wall 130 expands out to the default (i.e. relaxed/uncompressed) position (FIG. 15A) once the push force of the driver is removed, and pull force is substituted. The cavity expands in volume when the driver pulls the cup into expanded position. Accordingly, during the operational cycle, the volume of the cavity is cyclically varied to create a pressure field in the chamber during use.

Note that the diaphragm of the two-portion cup of FIGS. 2A and 2B operate similarly with the inner cup portion having a buckle region that buckles. Instead of the anchor walls, the rigid ring is the "stabilizer" that holds such that the buckling will happen in the buckle region.

The following configuration of the cup of FIGS. 15A and 15B is optimal for expansion from compressed position to default position to create the thud force. In embodiments, dimension X1 (height of the cup) ranges from 16 millimeters to 20 millimeters. In embodiments, dimension X2 (anchor wall 171) ranges from 6 millimeters to 10 millimeters. In embodiments, the buckle depth X3 ranges from 4 millimeters to 20 millimeters. In embodiments, the buckle width X4 ranges from 20 millimeters to 30 millimeters. In embodiments the minimum thickness 530 of the buckle region wall 192 ranges from 1 millimeter to 4 millimeters. In some embodiments the ratio of the buckle region minimum thickness 530 to the buckle depth ranges from 0.05 to 1.00. In some embodiments, the buckle region wall material has a Shore durometer value ranging from A5 to D30. In some embodiments, the Shore durometer is D30. Although these values are optimal, any suitable values for the variables described herein are included within the scope of the invention that can achieve the result described herein.

In some embodiments, the speed of the rotation of the cam is 10 to 5000 rpm. In some embodiments, the speed ranges from 300 rpm to 600 rpm. In some embodiments, the speed of the cam rotation is a setting that is user-adjustable, allowing the user to customize the operation of the stimulation device for their preference. The user can choose a higher speed for an increased frequency of pressure changes (and vis versa), and also control the frequency of the resulting cyclical thud forces.

Figure 16:
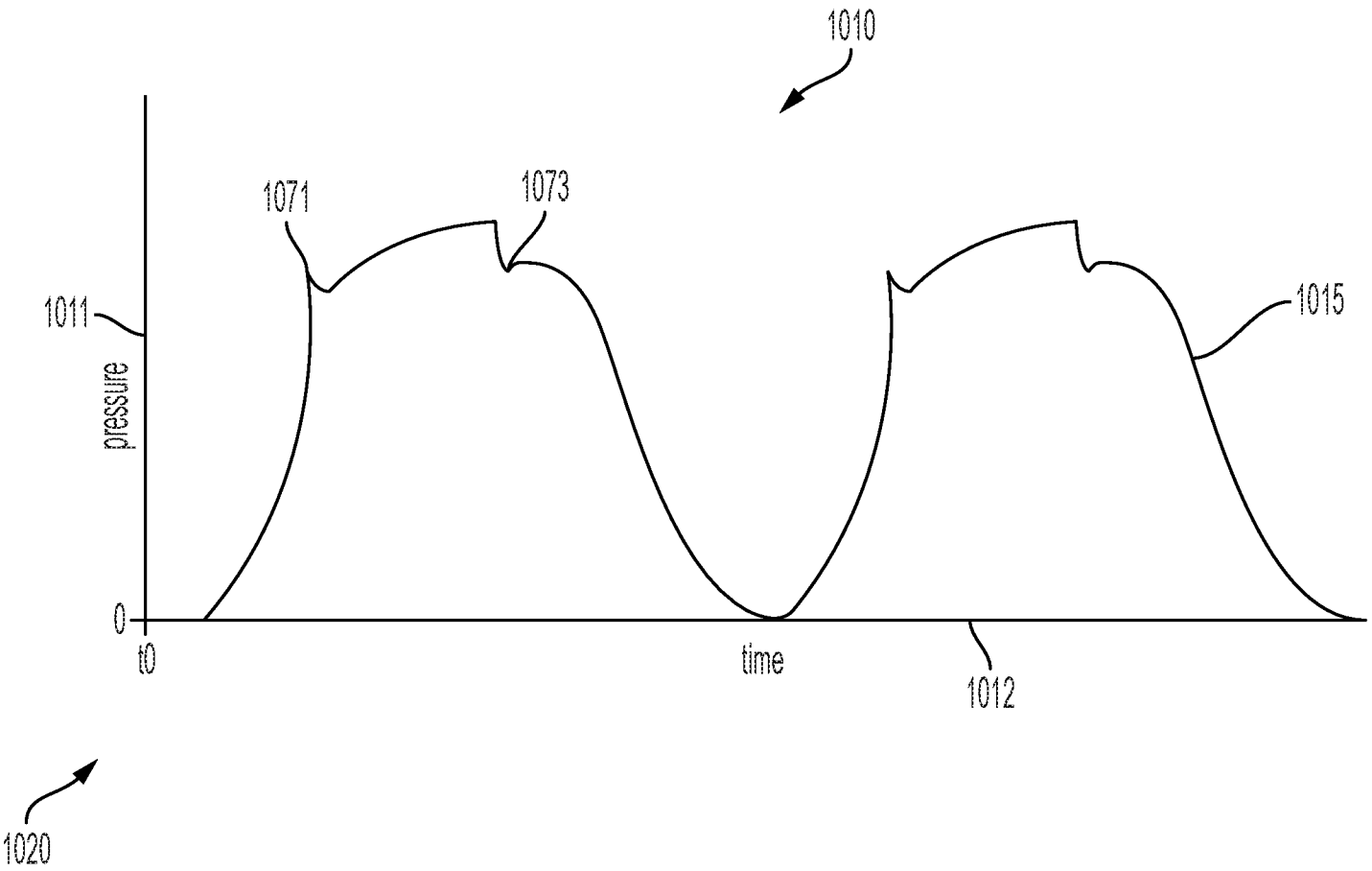
FIG. 16 is an example of a time-pressure graph showing a time-pressure relationship of the pressure within the chamber.

FIG. 16 is an example of a time-pressure graph 1010 showing a time-pressure relationship of the pressure within the chamber (e.g. 160 of FIG. 12 or 3160 of FIGS. 2A and 2B) formed in the cavity of the cup as the driver of FIGS. 12A and 12B operates. Graph 1010 comprises vertical axis 1011 representing pressure, and horizontal axis 1012 representing time. Zero on the vertical axis indicates gauge pressure at atmosphere. This is the ambient air pressure, at the geographic location that the user is using the stimulation device, that exists at the time the user uses the device. Zero on the horizontal axis represents t0 (time=zero). As the driver operates, a time-pressure curve 1015 is generated, indicating varying amounts of pressure that occur within the chamber during operation. Inflection points in the curve 1015, indicated as 1071 and 1073 occur due to slight impact of the bearing 2028 (FIG. 9A) on the slot 2031 (FIG. 14) in the lifter 2030 (FIG. 14) during operation. Note that this graph starts at 0 pressure and full volume. The cup would be pulled down and stretched at that point.

Figure 17A:
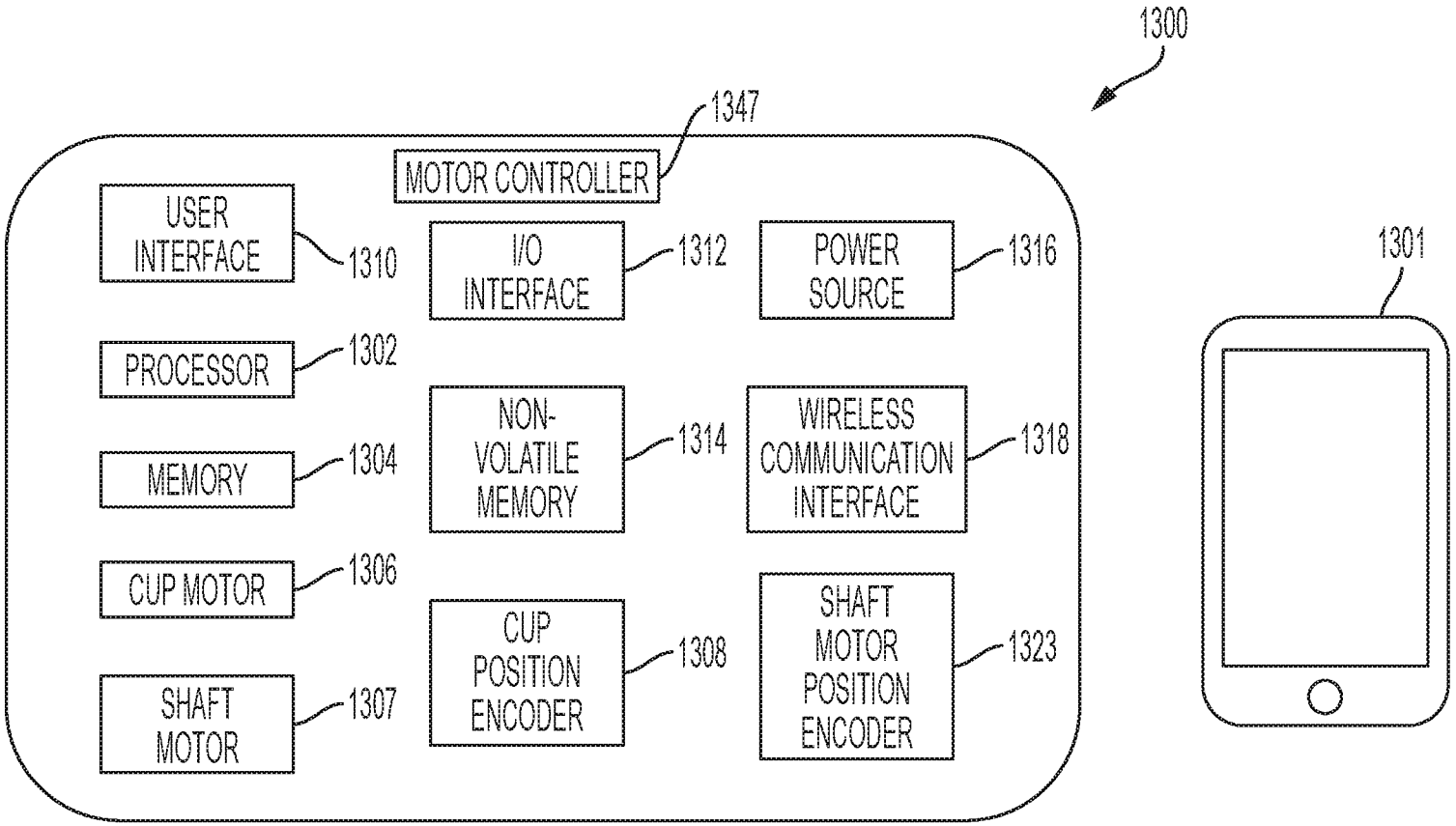
FIG. 17A is a block diagram of an embodiment of a stimulation device in accordance with disclosed embodiments.

FIG. 17A is a block diagram of an embodiment of a stimulation device 1300 in accordance with disclosed embodiments. The stimulation device includes a processor 1302 and memory 1304. Memory 1304 may be a computer-readable medium such as flash, battery-backed static RAM, or other suitable computer-readable medium. In some embodiments, the memory may be non-transitory. The memory 1304 contains instructions, that when executed by the processor 1302, perform steps in accordance with embodiments of the present invention. For example, in some embodiments, the memory contains instructions, that when executed by the processor, cause a driver to vary a volume of the cavity of the cup from a first volume to a second volume, and from the second volume to the first volume.

The stimulation device may include an onboard input/output interface 1312. This may include one or more input, output, and/or bidirectional pins for control of the stimulation device. User interface 1310 may include one or more buttons, switches, knobs, or other suitable controls disposed on the stimulation device. The buttons may be configured to create a signal on one or more input pins of the I/O interface 1312. The processor may utilize interrupt service routines or monitoring loops to detect button presses and change the operation of the cup motor 1306 accordingly. A position encoder 1308 may be internal to the cup motor 1306 (e.g., motor 2022 of FIG. 13), or external to the cup motor 1306, in some embodiments. In an alternative embodiment current peaks and valleys may be used to control the position of the motor.

In embodiments, motor controller 1347 receives signals from the input/output interface 1312. These can include signals indicative of desired operating speed, battery voltage level, and/or motor current draw. The motor controller 1347 includes components to operate a closed loop feedback system for control of the shaft motor 1307 and/or cup motor 1306, to provide a consistent user experience in terms of motor performance during various operating conditions. The operating conditions can include battery level/life remaining, and/or the induced load on the motor cause by the amount of force the user uses when pressing the device against his/her body. In embodiments, the motor controller 1347 may communicate with the processor 1302 through a communication bus, serial interface, or other suitable technique as is known in the art.

User interface 1310 may include a power on/off and one or more buttons, or a slider to vary the speed of the cam. Accordingly, a user may modify the strength of the pressure field via user input. Various settings are associated with corresponding speeds of the driver (e.g., rotations per minute of the cam). Accordingly, a user may choose that the stimulation device generates greater or lower pressure for their comfort level. The higher the speed, generally, the more intense the stimulation. The stimulation device may include non-volatile memory 1314 for storing user settings.

In some embodiments, instead of or in addition to an onboard user interface 1310, the stimulation device may include a wireless communication interface 1318. The wireless communication interface 1318 may include a Bluetooth®, Wi-Fi, or other suitable interface. The wireless communication interface allows pairing with an electronic device 1301 such as a dedicated remote controller, smartphone, tablet computer, or other electronic device. In some embodiments, the electronic device enables a rich user interface display, allowing for more complex programming options. Wireless communication interface 1318 may be in communication with a transceiver in the electronic device 1301. The stimulation device may be controlled by the user via an application on the smartphone or computer. Some embodiments may not have all of the aforementioned components.

The stimulation device further includes a power source 1316. In embodiments, the power source 1316 can include a battery. The battery can be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g., 12V DC).

In some embodiments, in addition to the pressure field stimulator, there is a second stimulator. The second stimulator may be mounted within a shaft (e.g., 3121 of FIG. 3). The second stimulator may have a motor 1307. Motor 1307 may be a geared motor mechanism that may have, e.g., an asymmetrical load affixed to a rotating shaft, a linear resonant actuator, or a pancake vibration motor, etc., for causing stimulation by, for example, a vibration pattern. In some embodiments, the second stimulator can be a vibrator, a pulsator, gyrator, oscillator, massager, or other suitable mechanism. Accordingly, the stimulation action may of the second stimulator may be vibration, pulsation, gyration, oscillation, massage (such as "come hither" type motion), or another. A position encoder 1323 (or other suitable control) may be internal to the motor 1307, or external to the motor 1307. It will be recognized that any suitable stimulation mechanism now known or hereafter developed may be substituted for, or used in addition to, the examples disclosed herein without departing from the scope and purpose of the present invention.

In some embodiments, the electronic device 1301 may provide a speech control function, in which a user can control the stimulation device 1300. In these embodiments, a user may utter a control word such as "faster" or "slower." Upon detecting a control word, the electronic device 1301 may issue a command (e.g. via wireless communication protocol such as Bluetooth®) which is received by processor 1302. Processor 1302, in response to receiving the control word, alters the operational speed of the motor 1307 and/or motor 1306 accordingly. In this way, hands-free adjustment of the device 1300 is possible.

Figure 17B:
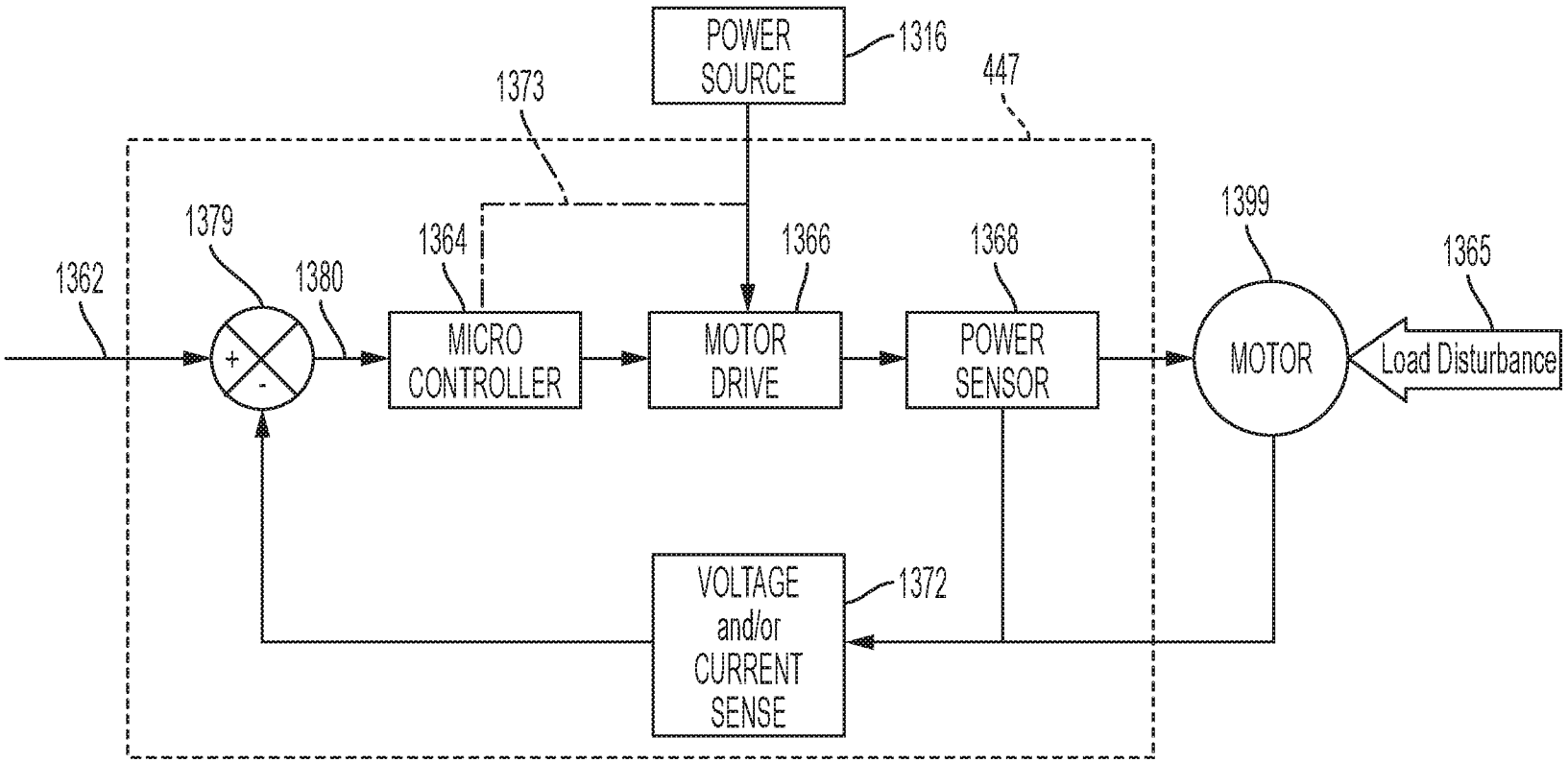

FIG. 17B shows details of a motor controller 1347 in accordance with embodiments of the present invention. The motor controller 1347 includes a microcontroller 1364. The microcontroller 1364 is coupled to a motor drive 1366 which contains additional circuitry for creating voltages suited to operation of motor 1399, which may be a cup motor 1399, which may represent a cup motor such as 1306 and/or a shaft motor such as 1307. A power sensor 1368 detects the amount of powering being drawn by the motor 1399. A closed loop control is accomplished by having a feedback path from the motor to voltage and/or current sense module 1372, to comparator 1379. Comparator 1379 also is configured to receive a user set point signal 1362. The user set point signal 1362 is indicative of a request speed of operation of the device. The microcontroller 1364 receives a signal 1380 based on the user set point signal and the voltage and/or current sense 1372. Additionally, a signal 1373 representative of the energy level of the power source 1302, such as batteries, that power the motor 1399 is also input to the microcontroller 1364. The microcontroller 1364 then performs computations to generate a corresponding output from the motor drive 1366 to control the motor 1399 at the desired speed. As the user presses a device against his/her skin, an increase in motor load (indicated by arrow 1365) occurs. The motor controller 1347 serves to maintain a consistent operational speed of motor 1399 during use, taking in to account the changing conditions of battery life, and the pressure the user applies on the motor during use. This provides an enhanced user experience by maintaining a desired speed, and hence, provides the type of massage the user wants.

FIG. 18A shows a front side perspective view of a stimulation device 1400 in accordance with some embodiments of the present invention. FIG. 18B shows a rear side perspective view of a stimulation device 1400 in accordance with some embodiments of the present invention. In embodiments, the device 1400 has a shaft 1419 and pressure field stimulator, referred to generally as 1401. The pressure field stimulator 1401 has a cup 1402 (which may be one piece, two pieces, or multiple) and driver components (installed within housing 1420). The shaft 1419 may be covered in a sheath 1403 such as silicone, TPE, or other suitable material. It is preferable that the material be non-permeable.

Shaft 1419 is adapted for insertion into a vagina or anus of a user. In some embodiments, shaft 1419 is an elongate shape. A shaft of any suitable insertable shape is included within the scope of embodiments of the invention. In some embodiments, housing 1420 and shaft 1419 are made from plastic, metal, or other suitable (preferably non-porous) material. Sheath 1403 may extend over a portion of housing 1420 (not viewable in this figure under sheath 1403). The shaft 1419 may include a second stimulator, including one or more of a vibrator, oscillator, gyrator, pulsator, and/or massaging stimulator, represented generally as 1421. User interface 1410 includes buttons and other controls for the driver, and second stimulator if present. Some embodiments provide simultaneous clitoral and G-spot stimulation. The device may be used hands-free such that after insertion of the shaft and positioning of the pressure field stimulator, the user can take their hands off the device during usage. In some embodiments, some components of the second stimulator are disposed within the housing 1420 of the pressure field stimulator. A power button 1415 is in view in FIG. 18A, and charging port 1429 is in view in FIG. 18B.

FIG. 19 shows another embodiment of a pressure field stimulation device 1500 in accordance with some embodiments of the present invention. Pressure field stimulation device 1500 includes housing 1520 with cup 1502 installed thereon. Driver components are installed therein. A handle 1522 is affixed to, or integral with, housing 1520 to enable a user to hold (in a hand) and/or manually position the stimulation device during use. In some embodiments, the handle 1522 may be curved such that the user can conveniently hold the stimulation device during use. In such embodiments, the device is hand-held during usage. In some embodiments, the housing 1520 and handle 1522 are made of plastic, metal, or other suitable (preferable non-porous) material. A sheath 1503 of silicone, TPE, or other suitable material may be disposed on the exterior of the housing and handle 1522. User interface 1510 includes at least one button or other control for the stimulation device. Charging port 1529 is in view.

In embodiments, the top of the cup swells (interchangeable herein with "stretches" or "expands") and unswells (interchangeable herein with "deswells" or "contracts" or "shrinks") during an operation cycle. It swells and unswells generally both laterally and vertically. FIGS. 20A-20B illustrate the swelling of the cup in width (lateral expansion and contraction). FIGS. 21A-22B illustrate the additional or alternative swelling in height (vertical expansion and contraction). When embodiments are in use, sealed or substantially-sealed against a user's skin, as the volume of the cavity changes during an operation cycle, the pressure inside the chamber changes, causing the swelling and unswelling of the elastic top cup surface 5107.

FIG. 20A and FIG. 20B are top-down views that illustrate lateral expansion and contraction during the operation cycle. FIG. 20A shows a top-down view of the cup (or outer cup portion in a two-piece cup configuration) 5102 as shown when the cup is in an uncompressed configuration. In some embodiments, a width of the cavity of the cup increases (swells) from a first width to a second width, during a transition from a first volume to a second volume, and decreases (unswells) when transitioning back from the second volume to the first volume, or vice versa. This is a result of the top cup surface 5107 increasing (swells) from a first width to a second width, during a transition from a first volume to a second volume, and decreasing (unswells) when transitioning back from the second volume to the first volume, or vice versa. This swelling and unswelling serves to mimic behavior of a human mouth engaged in oral sex with a vagina or vulva, serving to enhance the pleasure of the user during use of the device. In some embodiments, the cup has a top cup surface 5107 adjacent the cavity. In some embodiments, the top cup surface 5107 and swells when the cavity is sealed (or substantially-sealed) and the cam is actuated to create a positive pressure (or more positive pressure, as volume is reduced) in the cavity. Conversely, when pressure is reduced, the top cup surface unswells. In the operation cycle, the top cup surface 5107 expands because the other surfaces are more restricted. The user presses the top cup surface 5107 against their skin to seal the cavity of the device, creating a chamber within the cup. Thus, the top cup surface 5107 provides stimulation to the user across that surface, thereby enhancing the user's experience when using a device in accordance with these embodiments.

In the uncompressed configuration where the cup is unswelled, the outer cup 5102 has an outer width 271, and a cavity width 273, corresponding to a width of cavity 5106. FIG. 20B corresponds to a top-down view of the outer cup 5102 as shown when the cup is in a compressed configuration. In the compressed configuration where the cup is swelled, the cup 5102 has an outer width 275, and a cavity width 277, corresponding to a width of cavity 5106. The compressed configuration widths are greater than the corresponding uncompressed configuration widths. Thus, width 275 is greater than width 271. Similarly, width 277 is greater than width 273. In some embodiments, for the uncompressed configuration, width 271 is 42 millimeters and width 273 is 10 millimeters. In those embodiments, for the compressed configuration, width 275 is 43 millimeters and width 277 is 11.5 millimeters. In some embodiments, the widths of the compressed configuration are between 3 to 15 percent greater than corresponding widths of the uncompressed configurations. Note that these dimensions and values are examples, and other suitable dimensions and values are included within the scope of the invention where suitable in implementation of embodiments.

FIGS. 21A and 21B show a side cross-section view of the outer cup portion/sleeve of a two-cup configuration. FIG. 21A shows the top of the outer cup portion in an unswelled position, and FIG. 21B shows the top of the outer cup portion in a swelled position. In some embodiments, a height of the cavity of the cup increases (swells) from a first height to a second height, during a transition from a first volume to a second volume, and decreases (unswells) when transitioning back from the second volume to the first volume, or vice versa. In FIG. 21A, outer cup portion 4004 is shown integral with sleeve 4002. The top of outer cup portion 4004 has lip 4008 and substantially-flat surface 4010. FIG. 21B shows the outer cup portion 4004 with surface 4010', which is substantially-dome shaped, or "convex". This is created due to the pressure in the chamber formed by inner cup portion (not shown) and outer cup portion 4004 inside the cavity. Dashed line 4020 represents where surface 4010 of FIG. 21A is before swelling (with swelled surface labeled 4010'). The change in the height of the surface between positions indicated by 4010 and 4010', the undersurface 4009 and 4009', and 4008 and 4008' (if a lip is present) of the outer cup portion 4004 is result of vertical expansion and contraction. Thus, in embodiments, the thickness of the top of the cup is configured and disposed to undergo vertical expansion and contraction during an operation cycle. This swelling and unswelling serves to mimic behavior of a human mouth engaged in oral sex with a vagina or vulva, serving to enhance the pleasure of the user during use of the device.

FIG. 22A shows a front cross-section view of an outer cup portion/sleeve (of a two-cup configuration) with the outer cup portion 4004 in unswelled configuration. Surface 4010 is shown substantially flat (or at rest) at a height denoted by line 4107, lip 4008 is at height 4015, and undersurface is at height denoted by line 4113. FIG. 22B shows a front cross-section view of the outer cup/sleeve with the surface 4010' of the outer cup portion 4004' in swelled configuration. Surface 4010', undersurface 4009', and lip 4008' are shown swelled up.

Referring now also to FIG. 22B, the compressed (swelled) configuration heights are greater than the corresponding uncompressed (unswelled) configuration heights. Thus, swelled height 4111 of undersurface 4009' is greater than height 4113 of undersurface 4009. In some embodiments, the difference (D1) between height 4111 and height 4113 ranges from 0.25 millimeters to 3 millimeters. In some embodiments, the height 4111 represents an increase of 5 percent to 8 percent as compared with height 4113. In some embodiments, the difference (D2) between height 4019 of unswelled surface 4010 and height 4107 of swelled surface 4010' ranges from 0.25 millimeters to 3 millimeters. In some embodiments, the height 4019 represents an increase of 5 percent to 8 percent as compared with height 4107. In some embodiments, the difference (D3) between height 4015 of unswelled lip 4008 and height 4016 of swelled lip 4008' ranges from 0.25 millimeters to 3 millimeters. In some embodiments, the height 4016 represents an increase of 5 percent to 8 percent as compared with height 4015. Note that these dimensions and values are examples, and other suitable dimensions and values are included within the scope of the invention where suitable in implementation of embodiments. The entire thickness (or substantially the entire thickness) of the top 4004 of the cup increases during swelling between 5-8% as noted by D1, D2, and D3, and decreases similarly during unswelling.

Referring to FIGS. 20A-23, the top surface of the outer cup portion swells because the pressure increases as the bottom plate 3112 (FIG. 2A) (or lifter, where plate is not present) reduces the volume in the chamber (when sealed). An edge of the buckling region is substantially fixed (restricted) by ring 3104 (FIG. 5). This is an inflection point. The same surface process also happens with embodiments having a cup that is not split into two (i.e. one piece), e.g., cup 102 of FIGS. 1A-1E. Whereas the ring (3104 of FIG. 5) functions to hold an edge of the inner cup portion in place in the two-piece embodiment, the thick anchor walls (171 of FIG. 15A-15B) hold an edge of the buckling region of the cup in place in a one-piece embodiment. Top 105 of cup 102 (FIG. 1A) swells and unswells between inflection points 107 (FIG. 1B) at the anchor walls 171 (like outer side walls) (no break is shown between the top 105 and anchor walls 171, but in some embodiments, there could be an attachment point between the two). The anchor walls do not buckle, or buckle only after the buckling region does.

In other words, in embodiments, surface 5107 extends across a portion of the cavity between the fixed/restricted surfaces or edges without any surface within the cavity/chamber that would block or obstruct the air pressure from reaching the underside (3193 of FIG. 2B) of such surface 5107. See, for example, FIGS. 2A and 2B where there is no surface in the cavity under the underside of surface 104. There, it can also be seen that outer cup portion 3115 is held to the housing by ring 3104, thereby having restricted edges, whereas surface 3115 is not restricted otherwise. See also FIGS. 1A and 1B, where anchor wall 171 is restricted in movement while surface 104 is not. The top cup surface 104 extends over (i.e. covers) an entirety of the width of the cavity 106, or at least a portion thereof, of the cup, except where the opening 110 is—Same is true for other embodiments including the swelling and unswelling cup top feature.

FIG. 23 shows a partial top-down view of an embodiment 2002 of the invention, with a break line 2310. Cup 2108 has cavity 2106. Surface 2107 of the cup 2108 is the surface that swells to a dome shape and relaxes (unswells) to a substantially-flat shape, to create a "throbbing" on such surface. Some embodiments may undergo substantial lateral expansion and contraction without substantial vertical expansion. Some embodiments may undergo substantial vertical expansion and contraction without substantial lateral expansion. Some embodiments may undergo both vertical and lateral expansion.

Some embodiments are waterproof such that they may be washed with fluids, like soap and water. Accordingly, the attachment points of the sheath and any other external portions are sealed where necessary. This allows a user to clean the device thoroughly between insertions. In embodiments, the pressure field stimulation device is unitary in structure, meaning the components thereof together form a single product, rather than multiple products which may be used together by a user.

As can now be appreciated, disclosed embodiments provide an improved pressure field stimulation device utilizing a driver including a combination of roller bearings and linear bearings to create a smooth reciprocating motion. This approach reduces unwanted noise and vibration, and provides for an improved user experience. Note that the driver is not limited to working with the cups disclosed herein, and other cups can be substituted where feasible.

Disclosed embodiments also provide an improved pressure field stimulation device with a cup that expands and contracts. Note that the cups are not limited to working with the disclosed drivers, and other drivers can be substituted where feasible.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A stimulation device for stimulation of any body part by a user, the stimulation device comprising:

a cup formed of a flexible resilient material comprising a cavity, wherein the cavity is defined by an interior lateral wall and a base, wherein the base has a side inside the cavity and a side outside the cavity; and a driver, the driver comprising:

a plate mechanically coupled to the base of the cup on the side outside the cavity;

a cam disposed adjacent to the plate;

a cam pin extending from the cam;

a bearing disposed on the cam pin;

a motor mechanically coupled to the cam;

a lifter mechanically coupled to the bearing, said lifter also mechanically coupled to the plate; and a linear bearing, the linear bearing mechanically coupled to the lifter.

2. The stimulation device of claim 1, wherein the linear bearing is mechanically coupled to the lifter to enable reciprocating linear motion.

3. The stimulation device of claim 1, wherein:

the driver is configured to vary a volume of the cavity of the cup from a first volume to a second volume.

4. The stimulation device of claim 3, wherein the second volume is smaller than the first volume.

5. The stimulation device of claim 3, wherein the second volume is larger than the first volume.

6. The stimulation device of claim 1, wherein the plate is rigid.

7. The stimulation device of claim 1, wherein the stimulation device is a sex toy.

8. The stimulation device of claim 1, wherein the stimulation device is a pressure field stimulator.

9. The stimulation device of claim 1, wherein the lifter comprises a slot, and wherein the slot is configured and disposed to engage the bearing.

10. The stimulation device of claim 1, further comprising a handle.

11. The stimulation device of claim 1, further comprising a shaft insertable into a vagina of a user.

12. The stimulation device of claim 1, further comprising a shaft insertable into an anus of a user.

13. A stimulation device for stimulation of any body part by a user, the stimulation device comprising:

a cup formed of a flexible resilient material comprising a cavity, wherein the cavity is defined by an interior lateral wall and a base, wherein the base has a side inside the cavity and a side outside the cavity;

a driver, the driver comprising:

a plate mechanically coupled to the base of the cup on the side outside the cavity;

a cam disposed adjacent to the plate;

a cam pin extending from the cam;

a bearing disposed on the cam pin;

a motor mechanically coupled to the cam;

a lifter mechanically coupled to the bearing, said lifter also mechanically coupled to the plate; and a linear bearing, the linear bearing mechanically coupled to the lifter;

a processor; and a memory containing instructions that when executed by the processor cause the driver to vary a volume of the cavity of the cup from a first volume to a second volume.

14. The stimulation device of claim 13, wherein the memory further contains instructions that when executed by the processor cause the driver to vary the volume of the cavity of the cup from the second volume to the first volume.

15. The stimulation device of claim 13, wherein the linear bearing is mechanically coupled to the lifter to enable reciprocating linear motion.

16. The stimulation device of claim 13, wherein the cup is a single piece of silicone.

17. The stimulation device of claim 13, wherein the cup comprises an inner cup portion and an outer cup portion.

18. The stimulation device of claim 13, wherein the lifter comprises a slot, and wherein the slot is configured and disposed to engage the bearing.

19. The stimulation device of claim 13, further comprising a handle.

20. The stimulation device of claim 13, further comprising a shaft insertable into a vagina or anus of a user.

21. The stimulation device of claim 13, wherein the stimulation device is a pressure field stimulator.

* * * * *